US010410616B2

(12) United States Patent
Minamitaka

(10) Patent No.: US 10,410,616 B2
(45) Date of Patent: Sep. 10, 2019

(54) CHORD JUDGING APPARATUS AND CHORD JUDGING METHOD

(71) Applicant: CASIO COMPUTER CO., LTD., Shibuya-ku, Tokyo (JP)

(72) Inventor: Junichi Minamitaka, Kokubunji (JP)

(73) Assignee: CASIO COMPUTER CO., LTD., Tokyo (JP)

( * ) Notice: Subject to any disclaimer, the term of this patent is extended or adjusted under 35 U.S.C. 154(b) by 87 days.

(21) Appl. No.: 15/677,672

(22) Filed: Aug. 15, 2017

(65) Prior Publication Data

US 2018/0090118 A1 Mar. 29, 2018

(30) Foreign Application Priority Data

Sep. 28, 2016 (JP) ..... 2016-190423

(51) Int. Cl.
*G10H 1/38* (2006.01)
*G10H 1/00* (2006.01)
*G10H 1/40* (2006.01)

(52) U.S. Cl.
CPC ..... *G10H 1/383* (2013.01); *G10H 1/0066* (2013.01); *G10H 1/40* (2013.01); *G10H 2210/076* (2013.01); *G10H 2210/081* (2013.01); *G10H 2210/395* (2013.01); *G10H 2210/576* (2013.01); *G10H 2250/021* (2013.01)

(58) Field of Classification Search
CPC ..... G10H 1/383; G10H 1/0066; G10H 1/40; G10H 2210/076; G10H 2210/081; G10H 2210/385; G10H 2210/576; G10H 2250/021; G10H 2210/395
USPC ..... 84/613
See application file for complete search history.

(56) References Cited

U.S. PATENT DOCUMENTS 4,290,087 A * 9/1981 Bixby ..... G11B 27/005 386/202
4,429,606 A * 2/1984 Aoki ..... G10H 1/38 84/664
4,450,742 A * 5/1984 Sugiura ..... G10H 1/38 84/650

(Continued)

FOREIGN PATENT DOCUMENTS

JP 08007589 B2 1/1996
JP 11126075 A 5/1999

(Continued)

OTHER PUBLICATIONS

Related U.S. Appl. No. 15/677,656; Title: "Chord Judging Apparatus and Chord Judging Method"; First Named Inventor: Junichi Minamitaka; filed Aug. 15, 2017.

*Primary Examiner* — David S Warren
*Assistant Examiner* — Christina M Schreiber
(74) *Attorney, Agent, or Firm* — Holtz, Holtz & Volek PC

(57) ABSTRACT

A chord judging apparatus for judging chords of a musical piece, is provided with a processor and a memory for storing data of the musical piece, wherein the processor specifies plural segments in the data of the musical piece, estimates a tonality of each of the specified segments based on component tones included in the segment, and judges a chord of the plural segments of the musical piece based on modulation in tonality, when modulation is introduced in the estimated tonalities of the plural segments.

16 Claims, 17 Drawing Sheets

<table>
<tr><td>(a) iMeasNo</td><td>0</td><td>1</td><td>2</td><td>3</td><td>4</td><td>5</td><td>6</td></tr>
<tr><td>(b) pitch class power</td><td>re, fa, la</td><td>re, fa, sol, la</td><td>do, mi, sol, ti</td><td>do, fa, ra</td><td>mi ♭, sol, ti ♭</td><td>do, mi ♭, sol, ra ♭</td><td>re, fa, ra ♭, ti ♭</td></tr>
<tr><td>(c) iFrameType = 0</td><td>B ♭ :3</td><td>B ♭ :4</td><td>G:4</td><td>B ♭ :3</td><td>B ♭ :3</td><td>A ♭ :4</td><td>E ♭ :4</td></tr>
<tr><td rowspan="2">(d) iFrameType = 1</td><td colspan="2">B ♭ :4</td><td colspan="2">C:6</td><td colspan="2">A ♭ :5</td><td></td></tr>
<tr><td></td><td colspan="2">C:7</td><td colspan="2">B ♭ :6</td><td colspan="2">E ♭ :7</td></tr>
<tr><td rowspan="5">(e) iFrameType = 2</td><td colspan="4">C:7</td><td></td><td></td><td></td></tr>
<tr><td></td><td colspan="5">C:3.5</td><td></td></tr>
<tr><td></td><td></td><td colspan="4">A ♭ :3</td><td></td></tr>
<tr><td></td><td></td><td></td><td colspan="3">A ♭ :3.5</td></tr>
<tr><td></td><td></td><td></td><td></td><td colspan="3">A ♭ :2</td></tr>
<tr><td>judgment result</td><td>C:7</td><td>C:7</td><td>C:7</td><td>C:7</td><td>B ♭ :6</td><td>E ♭ :7</td><td>E ♭ :7</td></tr>
</table>

(56) References Cited

U.S. PATENT DOCUMENTS 4,499,808 A * 2/1985 Aoki ..... G10H 1/38 84/649
5,052,267 A * 10/1991 Ino ..... G10H 1/38 84/613
5,218,153 A * 6/1993 Minamitaka ..... G10H 1/38 706/902
5,302,776 A * 4/1994 Jeon ..... G10H 1/38 84/613
5,510,572 A * 4/1996 Hayashi ..... G10H 1/38 84/609
5,723,803 A * 3/1998 Kurakake ..... G10H 1/00 84/477 R
6,951,977 B1 * 10/2005 Streitenberger ..... G10H 1/0008 84/626
8,178,770 B2 5/2012 Kobayashi
10,062,368 B2 * 8/2018 Minamitaka ..... G10H 1/0066
2002/0029685 A1 * 3/2002 Aoki ..... G10H 1/38 84/613
2003/0094090 A1 * 5/2003 Tamura ..... G10H 1/0575 84/602
2004/0144238 A1 * 7/2004 Gayama ..... G10H 1/38 84/613
2004/0255759 A1 * 12/2004 Gayama ..... G10H 1/383 84/613
2005/0109194 A1 * 5/2005 Gayama ..... G10H 1/00 84/613
2006/0272486 A1 * 12/2006 Chen ..... G10H 1/386 84/637
2008/0307945 A1 * 12/2008 Gatzsche ..... G09B 15/023 84/477 R
2009/0151547 A1 * 6/2009 Kobayashi ..... G10G 3/04 84/613
2010/0126332 A1 * 5/2010 Kobayashi ..... G10H 1/383 84/613
2012/0060667 A1 * 3/2012 Hara ..... G10H 1/383 84/613
2014/0260915 A1 * 9/2014 Okuda ..... G10H 1/38 84/613
2016/0148605 A1 * 5/2016 Minamitaka ..... G10H 1/38 84/609
2016/0148606 A1 * 5/2016 Minamitaka ..... G10H 1/0025 84/609
2017/0090860 A1 * 3/2017 Gehring ..... G06F 3/165
2017/0092245 A1 * 3/2017 Kozielski ..... G10H 1/0025
2018/0090117 A1 * 3/2018 Minamitaka ..... G10H 1/0066
2018/0090118 A1 * 3/2018 Minamitaka ..... G10H 1/0066

FOREIGN PATENT DOCUMENTS

JP 2000259154 A 9/2000
JP 2007286637 A 11/2007
JP 2010122630 A 6/2010
JP 2012098480 A 5/2012
JP 2015040964 A 3/2015
JP 2015079196 A 4/2015

* cited by examiner

FIG.10

| pitch class | 0 | 1 | 2 | 3 | 4 | 5 | 6 | 7 | 8 | 9 | 10 | 11 |
|---|---|---|---|---|---|---|---|---|---|---|---|---|
| note / scale | C | C♯ | D | E♭ | E | F | F♯ | G | A♭ | A | B♭ | B |
| (a) major | 1 | 0 | 1 | 0 | 1 | 1 | 0 | 1 | 0 | 1 | 0 | 1 |
| (b) hminor | 1 | 0 | 1 | 0 | 1 | 1 | 0 | 0 | 1 | 1 | 0 | 1 |
| (c) mminor | 1 | 0 | 1 | 0 | 1 | 0 | 1 | 0 | 1 | 1 | 0 | 1 |
| (d) scale | 1 | 0 | 1 | 0 | 1 | 1 | 1 | 1 | 1 | 1 | 0 | 1 |

FIG.15

| pitch class | 0 | 1 | 2 | 3 | 4 | 5 | 6 | 7 | 8 | 9 | 10 | 11 |
|---|---|---|---|---|---|---|---|---|---|---|---|---|
| note / itype | C | C♯ | D | E♭ | E | F | F♯ | G | A♭ | A | B♭ | B |
| (a) major | 1 | 0 | 0 | 0 | 1 | 0 | 0 | 1 | 0 | 0 | 0 | 0 |
| (b) minor | 1 | 0 | 0 | 1 | 0 | 0 | 0 | 1 | 0 | 0 | 0 | 0 |
| (c) 7th | 1 | 0 | 0 | 0 | 1 | 0 | 0 | 1 | 0 | 0 | 1 | 0 |
| (d) minor7th | 1 | 0 | 0 | 1 | 0 | 0 | 0 | 1 | 0 | 0 | 1 | 0 |

CHORD JUDGING APPARATUS AND CHORD JUDGING METHOD

CROSS-REFERENCE TO RELATED APPLICATION

The present application is based upon and claims the benefit of priority from the prior Japanese Patent Application No. 2016-190423, filed Sep. 28, 2016, the entire contents of which are incorporated herein by reference.

BACKGROUND OF THE INVENTION

1. Field of the Invention

The present invention relates to a chord judging apparatus and a chord judging method for judging chords of a musical piece.

2. Description of the Related Art

There is a demand of extracting chords from music data. For instance, in general a standard MIDI (Musical Instrument Digital Interface) file includes a melody part and an accompaniment part. When a performer plays a musical piece with an electronic keyboard instrument, he/she can easily play a melody with his/her right hand and sometimes wants to enjoy playing the accompaniment part with his/her left hand. The standard MIDI files are preferable to include the accompaniment part but most of them have no such accompaniment part. As a matter of course, the performers who own valuable electronic keyboard instruments will want to play their instruments with their both hands. If chords of music can be judged and indicated from the standard MIDI file of a musical piece, it will be pleasure for the performers to play the chords with their left hands.

Several techniques of judging chords of music are disclosed in the following patent documents:

Japanese Unexamined Patent Publication No. 2000-259154,
Japanese Unexamined Patent Publication No. 2007-286637,
Japanese Unexamined Patent Publication No. 2015-40964, and
Japanese Unexamined Patent Publication No. 2015-79196.

SUMMARY OF THE INVENTION

According to one aspect of the invention, there is provided a chord judging method performed by a processor to judge chords of a musical piece whose data is stored in a memory, wherein the processor executes processes of estimating a first tonality based on component tones included in a first segment having a first length, the first segment being specified in the data of the musical piece; estimating a second tonality based on component tones included in a second segment having a second length different from the first length, the second segment being specified in the data of the musical piece and at least partially overlapping with the first segment; and comparing the estimated first tonality with the estimated second tonality to judge a tonality or a chord of the first segment of the musical piece.

According to another aspect of the invention, there is provided a chord judging apparatus for judging chords of a musical piece, provided with a processor and a memory for storing data of the musical piece, wherein the processor specifies plural segments in the data of the musical piece; estimates a tonality of each of the specified segments based on component tones included in the segment; and judges a chord of the plural segments of the musical piece based on modulation in tonality, when modulation is introduced in the estimated tonalities of the plural segments.

According to the invention as defined in the above claims, a tonality judgment which can judge modulation in tonality allows a more appropriate chord judgment.

BRIEF DESCRIPTION OF THE DRAWINGS

FIG. 10 is a view for explaining scale notes.

FIG. 15 is a view for explaining chord tones.

DETAILED DESCRIPTION OF THE PREFERRED EMBODIMENTS

Figure 1:
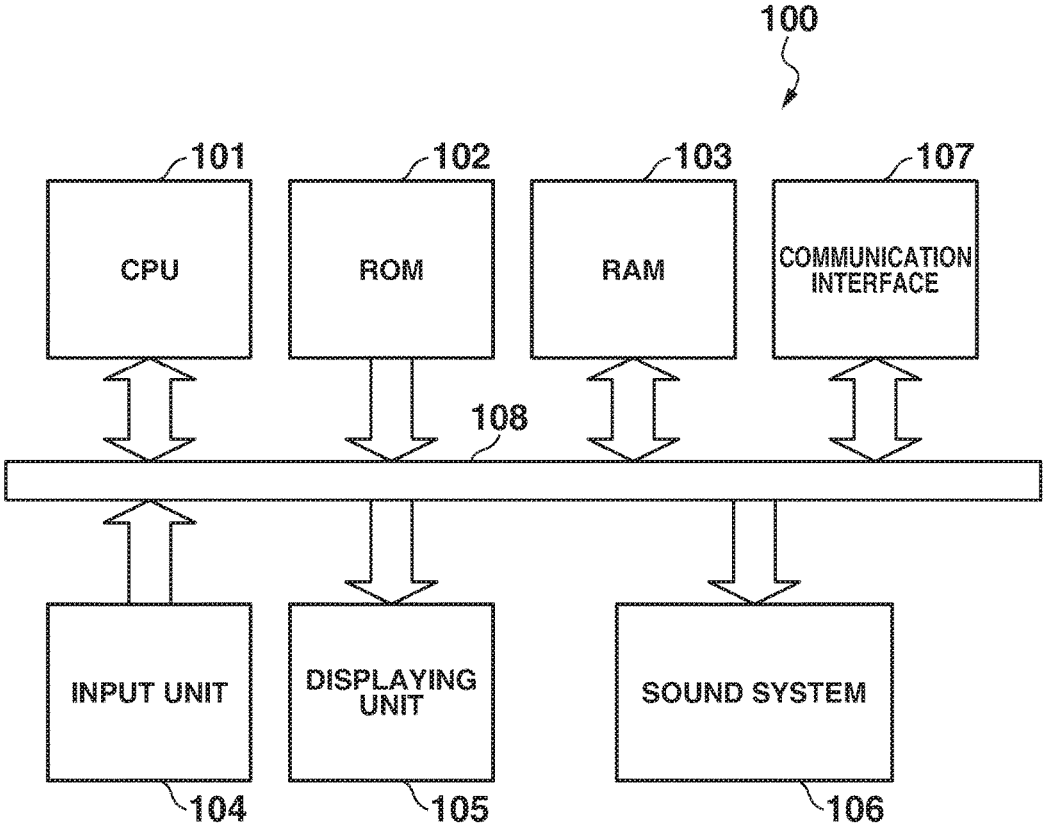
FIG. 1 is a view showing one example of a hardware configuration of a chord analyzing apparatus according to an embodiment of the present invention.

The embodiments of the present invention will be described with reference to the accompanying drawings in detail. FIG. 1 is a view showing an example of a hardware configuration of a chord analyzing apparatus 100, operation of which can be realized by a computer executing software.

The computer shown in FIG. 1 comprises CPU 101, ROM (Read Only Memory) 102, RAM (Random Access Memory) 103, an input unit 104, a displaying unit 105, a sound system 106, and a communication interface 107, all of which are connected with each other through a bus 108. The configuration shown in FIG. 1 is one example of the computer which realizes the chord analyzing apparatus, and such computer is not always restricted to the configuration shown in FIG. 1.

The CPU 101 serves to control the whole operation of the computer. The ROM 102 stores a chord-analysis processing program shown by flow charts of FIG. 4, FIG. 5, FIGS. 8-10, FIG. 13 and FIG. 14, and standard MIDI files of plural pieces of music data. The RAM 103 is used as a work memory while the chord-analysis processing program is executed. The CPU 101 reads the chord-analysis processing program from the ROM 102 and holds the same in the RAM 103 to execute the program. For instance, the chord-analysis processing program can be recorded on portable recording medium (not shown) and distributed or can be provided through the communication interface 107 from the Internet and/or a local area network.

The input unit 104 detects a user's input operation performed on a keyboard or by a mouse (both not shown), and gives notice of the detected result to the CPU 101. For instance, the input operation includes an operation of selecting a musical piece, an instructing operation of executing the chord-analysis, and an operation for playing back a musical piece. Further, it may be possible to down load a standard MIDI file of a musical piece through the communication interface 107 from the network, when the user operates the input unit 104.

The displaying unit 105 displays chord judgment data output under control of the CPU 101 on a liquid crystal display device.

When the user has operated the input unit 104 to obtain the standard MIDI file of a musical piece (music data) from the ROM 102 and/or the network and to instruct the play back of such standard MIDI file of a musical piece, the sound system 106 successively reads the sequence of the standard MIDI file of a musical piece and creates a musical tone signal using an instrument sound designated by the user to output the musical tone signal from a speaker (not shown).

Figure 2A:
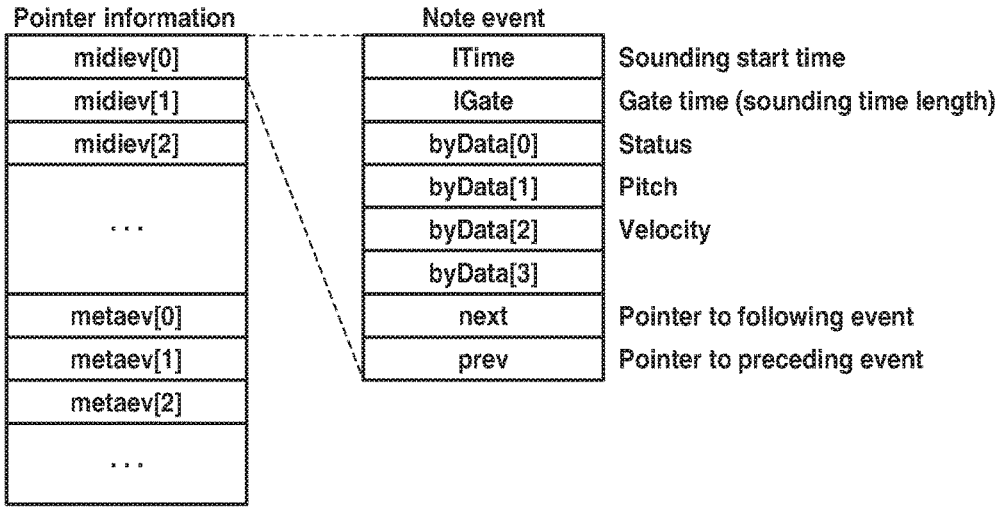
FIG. 2A is a view showing an example of a configuration of MIDI sequence data included in a standard MIDI file.

FIG. 2A is a view showing an example of a configuration of MIDI sequence data stored in the standard MIDI file which is read from the ROM 102 to the RAM 103 or downloaded from the Internet through the communication interface 107. The musical piece consists of plural parts (=tracks), and plural pieces of pointer information, midiev[0], midiev[1], midiev[2], . . . , which lead to note events respectively, are held at the heads of respective parts, as shown in FIG. 2A. The CPU 101 refers to the pointer information midiev[i] (i=0, 1, 2, . . . ) to access the first note event of the i-part recorded in the RAM 103.

The note event holds the following structure data. ITime holds a sounding start time. IGate holds a gate time (sounding time length). "Tick" is used as a unit to measure a time length. For example, a quarter note has a time length of 480 ticks and in a musical piece of a four-four meter, one beat has a time length of 480 ticks. byData[0] holds a status. byData[1] holds a pitch of a note made to sound. byData[2] holds a velocity of a note made to sound. byData[3] holds information required for controlling sounding of the note. "next" indicates a pointer which introduces the following note event, and "prev" indicates a pointer which introduces the previous note event. The CPU 101 refers to the "next" pointer and/or the "prev" pointer to access the following note event and/or the previous note event, respectively.

The CPU 101 refers to the pointer information such as metaev[0], metaev[1], metaev[2], . . . to obtain meta-information such as tempos and rhythms, which are necessary for controlling the sound system 106 to reproduce a musical piece.

Figure 2B:
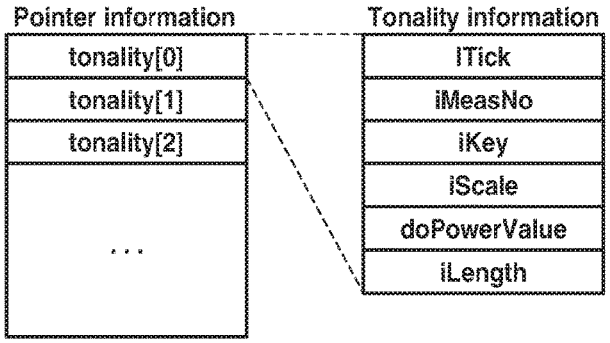
FIG. 2B is a view showing an example of a configuration of tonality data obtained as a result of a tonality judgment.

FIG. 2B is a view showing an example of a configuration of tonality data, which is obtained in a tonality judging process to be described later. Tonality information can be accessed through the pointer information tonality[0], tonality[1], tonality[2], . . . . The pointer information tonality[i] (i=0, 1, 2, . . . ) is a pointer which leads to the tonality information corresponding to the number "i" of a measure (measure number). The tonality information referred to through these pointers has the following data configuration. ITick holds a start time of a tonality of a melody of a musical piece. The unit of time (time unit) of ITick is "tick". iMeasNo holds the measure number of the measure whose tonality starts. iKey holds a key of the tonality. iScale holds a type of the tonality but is not used in the present embodiment of the invention. doPowerValue holds a power evaluation value when a tonality judgment is made. iLength holds a length of a frame or segment (frame length or segment length) in which a tonality is judged. As will be described later, iLength of a frame or segment, using the unit of "measure" is indicated by 1, 2 or 4.

Figure 3:
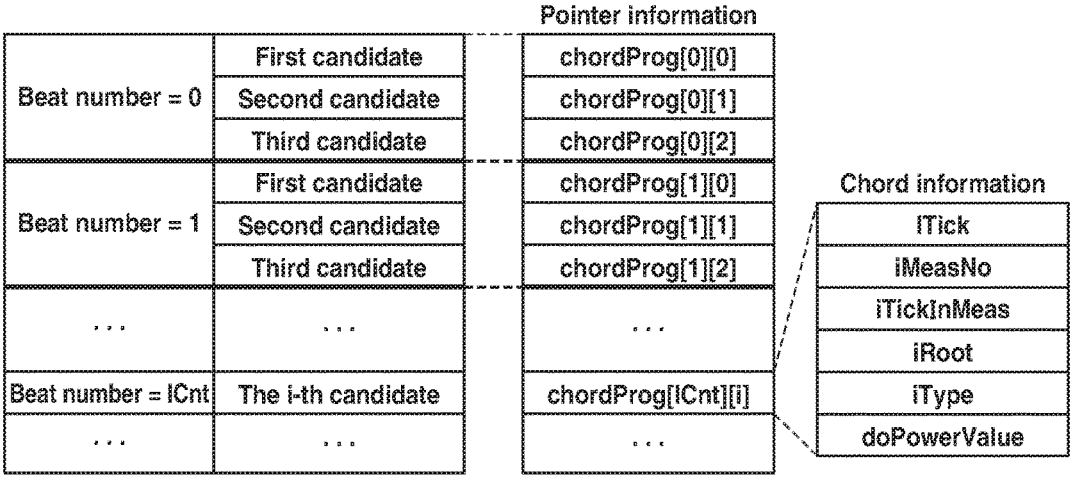
FIG. 3 is a view showing an example of a configuration of chord progressing data obtained as a result of a tonality judgment.

FIG. 3 is a view showing an example of a configuration of chord progressing data to be obtained in a chord judging process, which will be described later. The chord progressing data is allowed to have plural candidates for a chord, for example, the first candidate, the second candidate, and the third candidate, . . . , for each beat in each of the measures composing a musical piece. Assuming that the consecutive number of the beat number counted from the head of a musical piece is the first element number ICnt (ICnt=0, 1, 2, . . . ) and the candidate number in each beat is the second element number "i" (i=0, 1, 2, . . . ), each piece of chord progressing data can be accessed to from the pointer information chordProg[ICnt][i]. The chord information accessed from the pointer information holds the following data configuration. iTick holds a start time of a chord of a melody. The time unit of ITick is "tick", as described above. iMeansNo holds the measure number of a tonality. iTickInMeas holds a start time of a chord in a measure. The time unit of iTickInMeas is "tick", as described above. Since the chord is judged for each beat in the present embodiment, a beat unit is used as the time unit of iTickInMeas, and will be either of one beat, two beats, three beats or four beats. As described in FIG. 2A, since one beat is 480 ticks, the time unit of iTickInMeas will be either of 0, 480, 960, or 1440. iRoot holds a result of a chord judgment (root). iType holds a result of a chord judgment (type). doPowerValuen holds a power evaluation value when the chord judgment is made.

Figure 4:
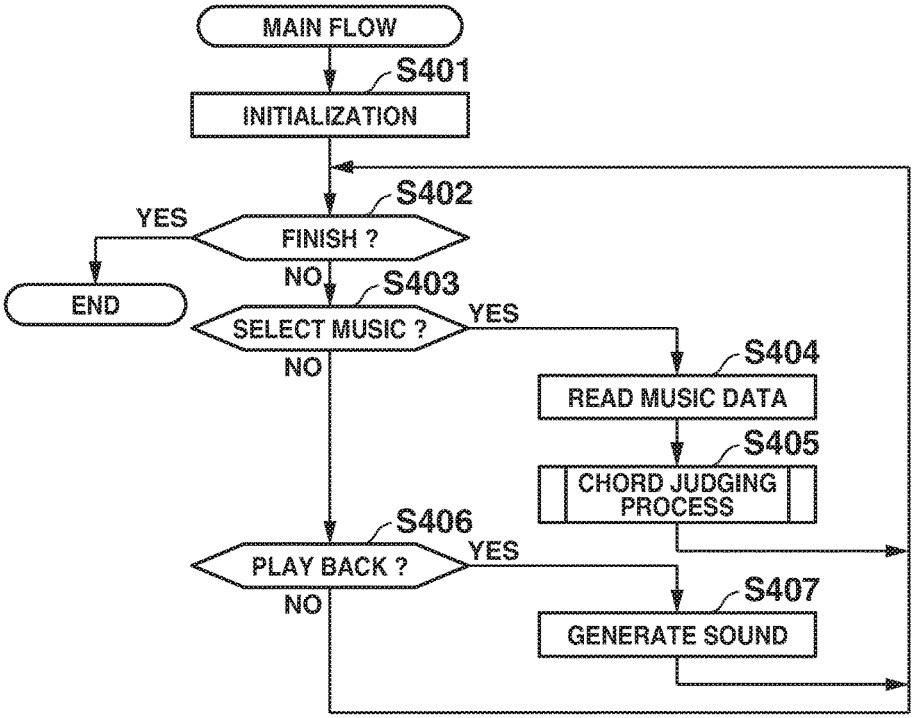
FIG. 4 is a flow chart of an example of the whole process performed by a CPU in the chard analyzing apparatus.

FIG. 4 is a flow chart of an example of the whole process performed by the CPU 101 in the chard analyzing apparatus. For instance, assuming that the chord analyzing apparatus 100 shown in FIG. 1 is composed of a general purpose computer used in smart phones, and when a user taps an application program on the chord analyzing apparatus 100, the CPU 101 starts the chord analyzing process shown in FIG. 4. At first, the CPU 101 performs an initializing process to initialize variables stored in a register and RAM 103 (step S401). Then, the CPU 101 repeatedly performs the processes from step S402 to step S408.

The CPU 101 judges whether the user has tapped a specified button on an application program to instruct to finish the application program (step S402). When it is determined that the user has instructed to finish the application program (YES at step S402), the CPU 101 finishes the chord analyzing process shown by the flow chart of FIG. 4.

When it is determined that the user has not yet instructed to finish the application program (NO at step S402), the CPU 101 judges whether the user has operated the input unit 104 to instruct to select a musical piece (step S403).

When it is determined that the user has instructed to select a musical piece (YES at step S403), the CPU 101 reads MIDI sequence data of the standard MIDI file of the musical piece having the data format shown in FIG. 2A from the ROM 102 or from the network through the communication interface 107 and holds the read MIDI sequence data in the RAM 103 (step S404).

Then, the CPU 101 performs the chord judging process to be described later to judge chords of the whole MIDI sequence data of the musical piece, which was instructed to read in at step S404 (step S405). Thereafter, the CPU 101 returns to the process at step S402.

When it is determined that the user has not instructed to select a musical piece (NO at step S403), the CPU 101 judges whether the user has operated the input unit 104 to instruct to play back a musical piece (step S406).

When it is determined that the user has instructed to play back a musical piece (YES at step S406), the CPU 101 interprets the MIDI sequence data held in RAM 103 and gives the sound system 106 an instruction of generating sound to playback the musical piece (step S407). Thereafter, the CPU 101 returns to the process at step S402.

When it is determined that the user has not instructed to play back a musical piece (NO at step S406), the CPU 101 returns to the process at step S402.

Figure 5:
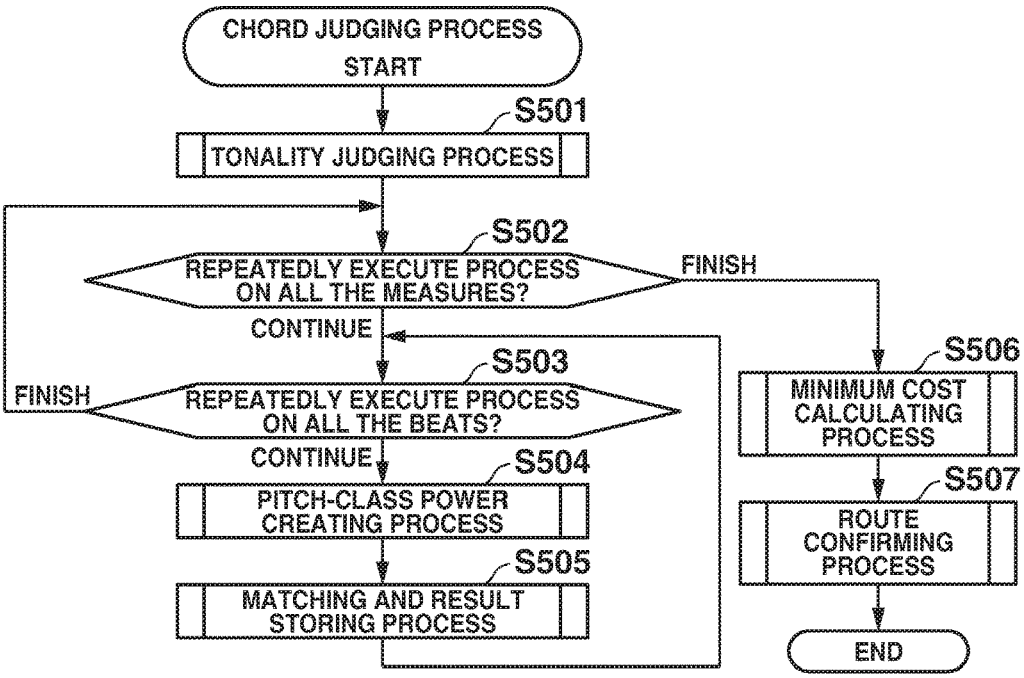
FIG. 5 is a flow chart showing an example of a chord judging process in detail.

FIG. 5 is a flow chart of an example of the detailed chord judging process to be executed at step S405 of FIG. 4.

The CPU 101 executes the tonality judging process to determine a tonality of each measure in the musical piece (step S501 in FIG. 5). Then, as a result of execution of the tonality judging process, tonality data having a data structure shown in FIG. 2B is obtained in the RAM 103.

The CPU 101 repeatedly executes a series of processes (step S503 to step S505) on each of the measures in the musical piece (step S502).

While repeatedly executing the processes on all the measures, the CPU 101 repeatedly executes the processes at step S504 and step S504 on each of all the beats in the measure. At step S504, the CPU 101 executes a pitch-class power creating process in each beat. In the pitch-class power creating process, the CPU 101 judges component tones in the beat as a pitch-class power. The detail of the pitch-class power creating process will be described with reference to FIG. 10 and FIG. 11.

At step S505, the CPU 101 executes a matching and result storing process. In the matching and result storing process, the CPU 101 judges the component tones of the beat based on accumulated values of power information of each pitch class in the current beat calculated at step S504, and decides the chord of the beat based on the component tones in the beat. The detailed process will be described with reference to FIG. 14 later. Thereafter, the CPU 101 returns to the process at step S503.

When the processes at step S504 and the step S505 have been executed in all the beats falling in the measure and the chord progressing data corresponding to all of the beats in the measure has been created, then the CPU 101 returns to the process at step S502.

When a series of processes (step S502 to step S505) have been executed on all the measures of the musical piece and the chord progressing data corresponding to all of the beats in all of the measures of the musical piece has been created, then the CPU 101 moves to the process at step S506.

In the process at step S506, the CPU 101 calculates a combination of chords whose cost will be the minimum in the whole musical piece from among all the combinations of the chord progressing data, which chord progressing data consists of plural candidates of the data format shown in FIG. 3, obtained with respect to all the measures of the musical piece and all the beats in such all the measures. This process will be described with reference to FIG. 16 to FIG. 18 in detail later.

As a result, the CPU 101 confirms a route of the chord progression all over the whole musical piece, whereby the optimum chords are determined (step S507). This process will be described with reference to FIG. 16 to FIG. 19 in detail. When the user instructs on the input unit 104, the optimum chords are displayed on the displaying unit 105. In accordance with the user's instruction, the optimum chord progression is displayed on the displaying unit 105. In response to the user's instruction, the optimum chords are successively displayed on the displaying unit 105 in synchronism with the play-back operation (at step S407 in FIG. 4) of the musical piece by the sound system 106. Thereafter, the CPU 101 finishes the chord judging process (at step S405 in FIG. 4) displayed by the flow chart of FIG. 5.

Figure 6:
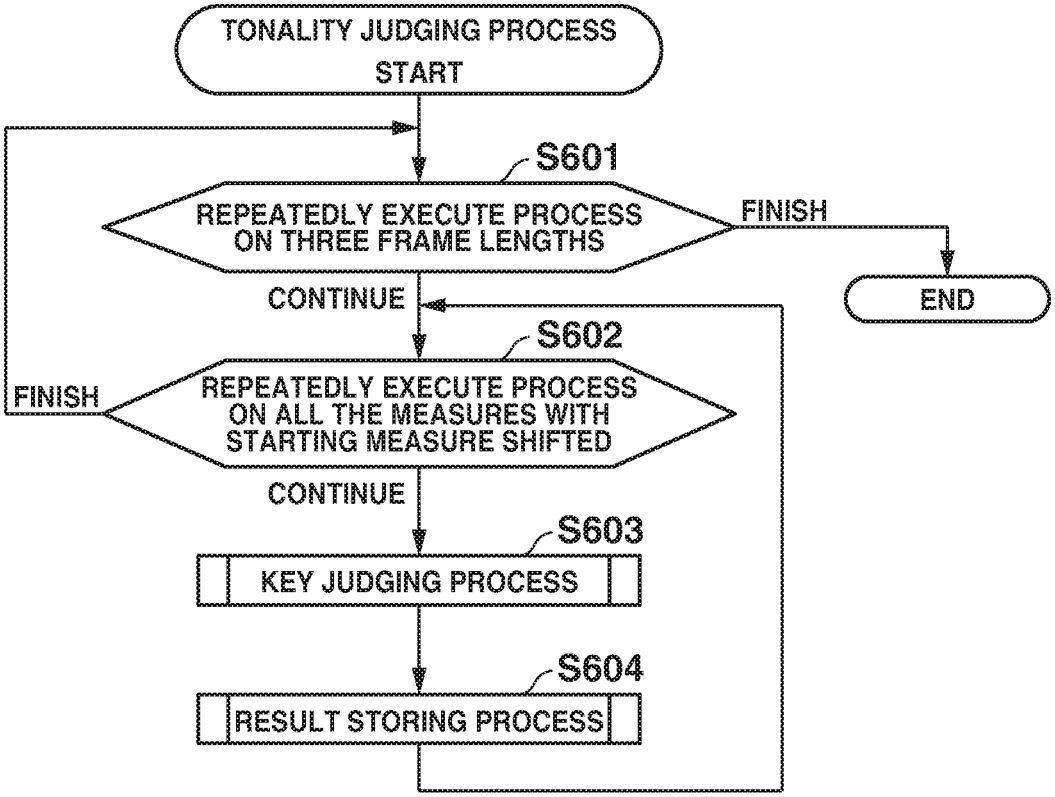
FIG. 6 is a flow chart showing an example of a tonality judging process in detail.
Figure 7A:
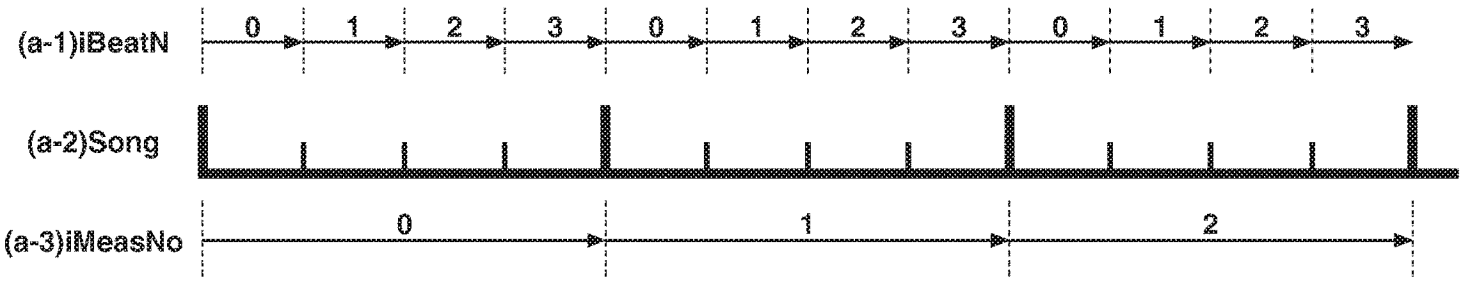
FIG. 7A is a view for explaining measures and beats in a musical piece.
Figure 7B:
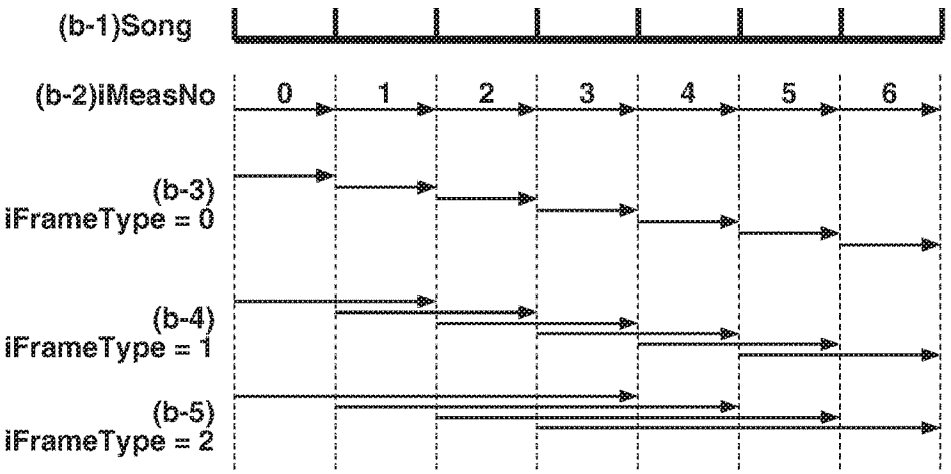
FIG. 7B is a view for explaining the tonality judgment.

The tonality judging process (step S501 of FIG. 5) will be described in detail hereinafter. FIG. 6 is a flow chart showing an example of the tonality judging process at step S501 in FIG. 5. FIG. 7A is a view for explaining measures and beats and FIG. 7B is a view for explaining a tonality judgment.

In the case of the musical piece of a quadruple meter read on the RAM 103, the measure number iMeasNO advances in the following way 0, 1, 2, . . . , as shown at (a-3) in FIG. 7A, as the musical piece (Song) progresses as shown at (a-2) in FIG. 7A. And the beat number iBeatNO is repeated in the following way 0, 1, 2, 3 within each measure as shown at (a-3) in FIG. 7A.

In the flowchart of the tonality judging process shown in FIG. 6, the CPU 101 successively chooses a frame length (or a segment length) from among plural frame lengths (plural segment lengths) as the musical piece (b-1) (Song) and the measure number (b-2) iMeasNo progress (Refer to FIG. 7), and executes the following process (step S601). The frame length has a unit of multiples of one measure, and the plural frame lengths are a 1-measure frame length (b-3), 2-measure frame length (b-4), and 4-measure frame length (b-5) (Refer to FIG. 7B). In the following description, the 1-measure frame length) will be expressed as iFrameType=0, the 2-measure frame length will be expressed as iFrameType=1, and the 4-measure frame length will be expressed as iFrameType=2.

The selection of the frame length is not restricted to from among the 1-measure frame length, 2-measure frame length, or 4-measure frame length, but for instance the frame length may be chosen from among a 2-measure frame length, 4-measure frame length, or 8-measure frame length. The CPU 101 shifts by one measure the starting measure of each of frames (indicated by arrows (b-3), (b-4) and (b-5) in FIG. 7B), into which the musical piece is divided by the frame lengths iFrameType=0, 1, 2 (step S602) and then executes the following process for each frame with the starting measure shifted.

The CPU 101 executes a key judging process (step S603). In the key judging process, the CPU 101 judges component tones in each frame defined by iFrameType and further judges a tonality of the judged component tones (the CPU 101 works as a key judging unit). This process will be described with reference to FIG. 9 to FIG. 12 in detail later.

Figure 8:
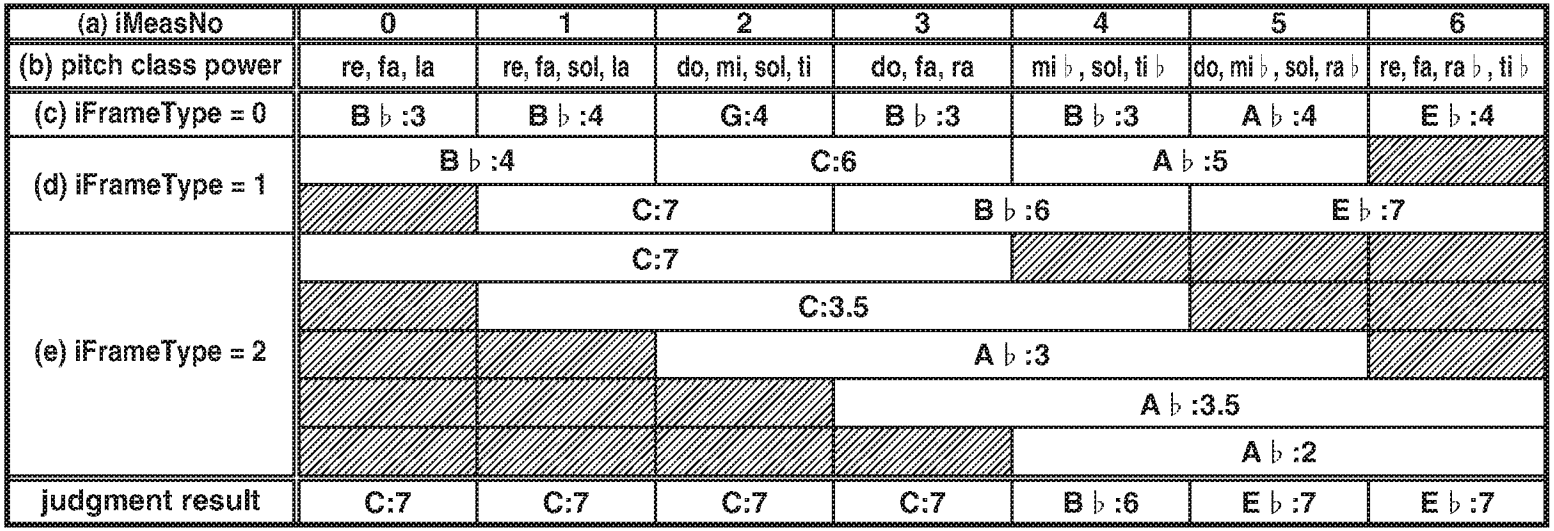
FIG. 8 is a view showing an example of a result of the executed tonality judging process.

FIG. 8 is a view showing an example of a result obtained in the tonality judging process. In the result shown in FIG. 8, the measure numbers iMeasNo are indicated at (a). Note groups (b) corresponding respectively to the measure numbers (a) indicate notes which are made to generate sound in the MIDI sequence data.

As shown in the result of FIG. 8, for instance, for (c) the 1-measure frame length iFrameType=0, the tonalities: B♭, B♭, G, B♭, B♭, A♭, and E♭ are judged respectively to (a) the measure numbers iMeasNo which are successively displaced by one measure number. For example, at the measure number=3 and iFrameType=0, the indication of "B♭: 3" means that when the tonality B♭ is determined, an evaluation value of "a power evaluation value=3" is obtained. This evaluation value will be described later. The evaluation value represents that when the value is larger, the tonality judgment will be higher in reliability.

Further, for (d) the 2-measure frame length iFrameType=1, the tonalities: B♭, C, C, B♭, A♭, and E♭ are judged for (a) the measure numbers iMeasNo which are successively displaced by one unit (two measures). The tonality judgment is made in order of the upper tier, lower tier, upper tier, lower tier, . . . as shown at (d) in FIG. 8.

For (e) the 4-measure frame length iFrameType=2, the tonalities: B♭, C, C, A♭, A♭, and A♭ are judged for (a) the measure numbers iMeasNo which are successively displaced by one unit (four measures). The tonality judgment is made from the upper left tier to the lower right tier as shown at (e) in FIG. 8.

Having executed the key judging process at step S603 in FIG. 6, the CPU 101 executes a result storing process at step S604. As described above, the frame lengths, iFrameType=0 (1-measure frame length), iFrameType=1 (2-measure frame length), and iFrameType=2 (4-measure frame length) are successively designated at step S601, and the key judging process is repeatedly executed for the designated frame lengths and the tonalities are determined for the designated frame lengths at step S603. In the result storing process, the tonalities determined for the overlapping frame lengths are compared and the optimum tonality is determined at present (step S604). (The CPU 101 works as a tonality determining unit.) The result storing process will be described with reference to FIG. 13 in detail later.

As shown in the example of FIG. 8, at the time when the key judging process (step S603) has been executed on (a) the measure number iMeasNo=0 for the frame lengths of (c) iFrameType=0 and (d) iFrameType=1, a key note B♭ and the power evaluation value 3, and a key note B♭ and the power evaluation value 4 are judged respectively for (c) iFrameType=0 and (d) iFrameType=1 in the tonality judgment. Therefore, in the result storing process (step S604) following the key judging process, the key note B♭ and the power evaluation value 4 are selected since the power evaluation value 4 is larger than the power evaluation value 3, and it is decided that the key note B♭ and the power evaluation value 4 are the optimum tonality at the time. Further, at the time when the key judging process (step S603) has been executed for the frame lengths of (c) iFrameType=0, (d) iFrameType=1, and (e) iFrameType=2, the key note B♭ and the power evaluation value 4 and the key note C and the power evaluation value 7 are judged at the time. Therefore, it is finally decided in the result storing process that the key note C is the optimum tonality. As a result, the CPU 101 has created tonality information of a data format shown in FIG. 2B in the RAM 103. In the tonality information, ITick stores a start time of the head of the measure of iMeasNo; iMeasNo stores the measure number 0 (the measure number=0); iKey stores a key value=0 corresponding to the key note "C" decided as the optimum tonality; doPowerValue stores the power evaluation value 7 given when the optimum tonality is decided; and iLength stores a value of "2" of iFrameType used when the optimum tonality is decided.

As shown in the example of FIG. 8, with respect to the measure numbers iMeasNo=1 to 3 shown at (a) in FIG. 8, it is determined that the optimum tonality is the key note "C" and the power evaluation value 7 is obtained, for each measure, and the tonality information of the data format shown in FIG. 2B is created in the same manner as described above. Further, with respect to the measure number iMeasNo=4, the key note B♭ having largest power evaluation value 6 is selected for iFrameType=1 (2-measure frame length). With respect to the measure numbers of iMeasNo=4 and 6, the key note F having the largest power evaluation value 7 is selected for iFrameType=1 (2-measure frame length). This means that when the measure number iMeasNo=3 changes to the measure number iMeasNo=4, the tonality was modulated.

As described above, in the present embodiment of the invention the result of tonality judgment made on the plural frame lengths iFrameType is comprehensively evaluated. Therefore, even if the tonality is modulated, since the judgment results made for the short frame length such as 1-measure frame length and/or 2-measure frame length are employed based on the power evaluation values, it is possible to detect modulation of tonality. Further, even in the case that it is impossible only in one measure to confirm sounding enough for judging a chord, since the judgment result made on a longer frame length such as 2-measure frame length and/or 4-measure frame length is employed based on the power evaluation value, it is possible to make an appropriate judgment. Further, in the embodiment, when a power evaluation value is calculated as described later, since a tone other than the scale tones of the tonality is taken into consideration, a precise tonality judgment can be maintained.

After having executed the process at step S604, the CPU 101 returns to the process at step S602. The CPU 101 repeatedly executes the key judging process (step S603) and the result storing process (step S604) on every measure of the musical piece with respect to one value of iFrameType with the frame start measure shifted by one measure. When having finished the above processes on every measure, the CPU 101 returns to the process at step S601. Then, the CPU 101 repeatedly executes a series of processes (step S602 to step S604) with respect to all the measure frame lengths, iFrameType=0, 1 and 2. When the processes at step S602 to step S604 have been finished with respect to iFrameType=0, 1 and 2, the tonality judging process (step S501 in FIG. 5) shown by the flow chart of FIG. 6 finishes.

Figure 9:
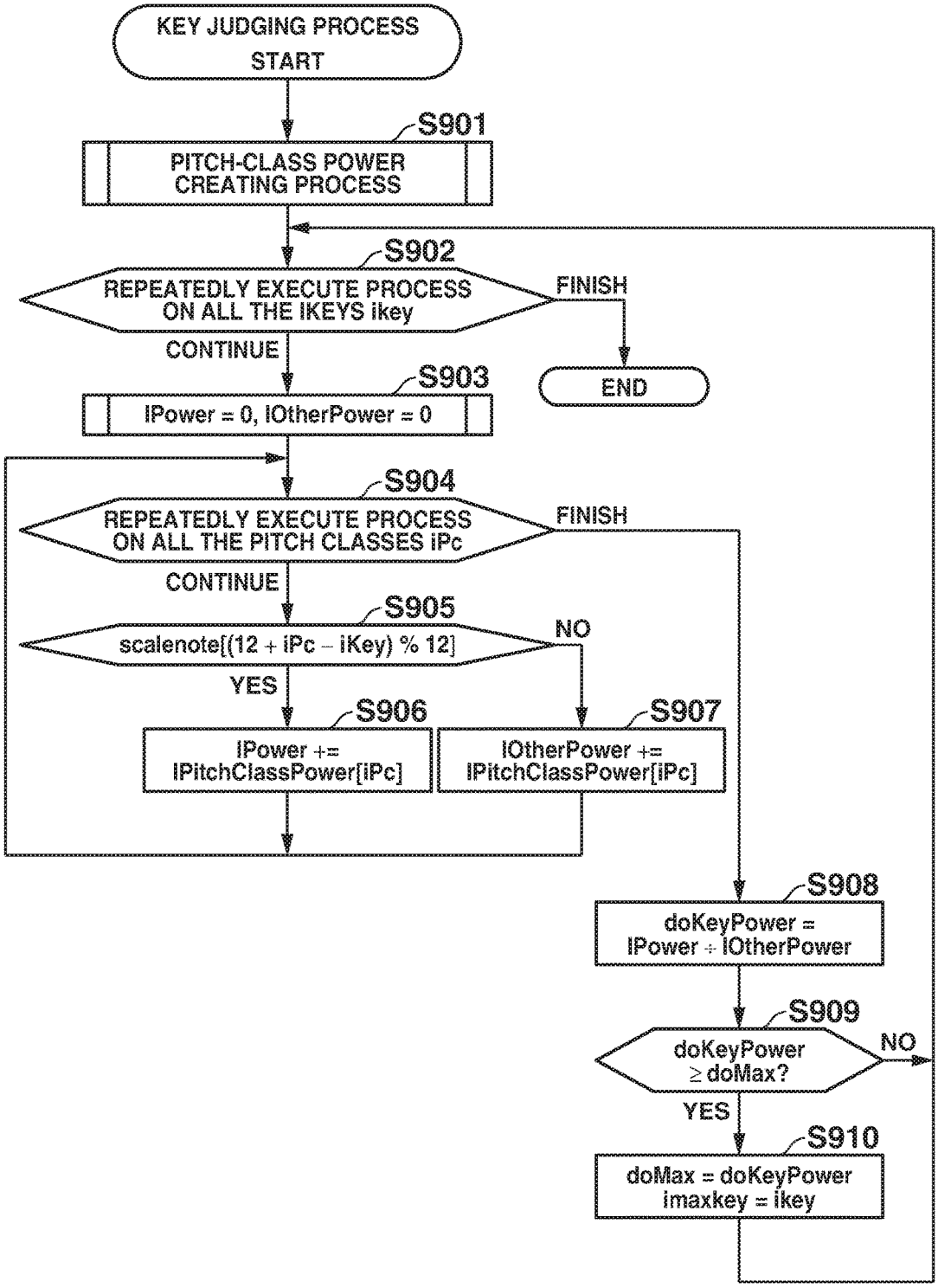
FIG. 9 is a flow chart showing an example of a detailed key judging process in the tonality judging process of FIG. 6.

FIG. 9 is a flow chart showing an example of the key judging process (step S603) in the tonality judging process of FIG. 6. The CPU 101 executes a pitch class power creating process (step S901). In the pitch class power creating process, the CPU 101 decides a power information value based on a velocity and a sounding time length of a note event made note-on in the frame length of 1-measure, 2-measures or 4-measures; and accumulates the power information values to pitch classes corresponding respectively to the pitches of the notes of the musical piece; and calculating a power information accumulated value of each pitch class in the corresponding frame. The pitch class is an integer value given to each halftone when one octave is divided into 12 by 12 halftones. For instance, in one octave the note C corresponds to the integer value 0; the note C♯ or D♭ corresponds to the integer value 1; the note D corresponds to the integer value 2; the note D♯ or E♭ corresponds to the integer value 3; the note E corresponds to the integer value 4; the note F corresponds to the integer value 5; the note F♯ or G♭ corresponds to the integer value 6; the note G corresponds to the integer value 7; the note G♯ or A♭ corresponds to the integer value 8; the note A corresponds to the integer value 9; the note A♯ or B♭ corresponds to the integer value 10 and the note B corresponds to the integer value 11, respectively. In the present embodiment, the tonality is judged on every frame having the 1-measure frame length, 2-measure frame length or 4-measure frame length. The key notes expressing the tonality and scale notes are determined as a combination of notes independent of an octave. Therefore, the present embodiment, the CPU 101 refers to a sounding start time ITime and a gate time (sounding time lengths) IGate of each note event (having the data format of FIG. 2A) stored in the RAM 103 to search for a note made to generate sound in the frame, and divides the pitch (byData[1] in FIG. 2A) of the note by 12 to find and transfer a reminder of any of 0 to 11 to a pitch class. The CPU 101 accumulates the power information values determined based on the velocity and its sounding time length of the note in the frame in the pitch class corresponding to the note and calculates the power information accumulated value of each pitch class in the beat. Assuming that the pitch class is iPc (0≤iPc≤11), a power conversion value in each pitch class iPc (0≤iPc≤11) created in a pitch class power creating process (step S901) is taken as a pitch class power IPichClassPower[iPc]. The above process will be described with reference to FIG. 10 and FIG. 11 in detail later.

Then, the CPU 101 executes a series of processes (step S903 to step S910) with respect to all the values of ikey from 0 to 11 expressing the key value of the tonality (step S902). At first, the CPU 101 executes a series of processes at step S903 to step S908.

More specifically, the CPU 101 clears the first power evaluation value IPower and the second power evaluation value IOtherPower to "0" (step S903).

Then, the CPU 101 executes the processes at step S905 to step S907 with respect to each of the pitch classes iPc having a value from 0 to 11 (step S904).

The CPU 101 judges whether the current pitch class iPc designated at step S904 is included in the scale notes of the tonality determined based on the current key value ikey designated at step S902 (step S905). The judgment at step S905 is made based on calculation for determining whether a value of scalenote[(12+iPC−ikey) %12] is 1 or not. FIG. 10 is a view for explaining the scale notes. In FIG. 10, the respective lines of (a) major, (b) hminor and (c) mminor indicate pitch classes and notes composing scales respectively in a major scale, a harmonic minor scale and a melodic minor scale in the case that a key value of the tonality is a pitch class=0 (note=C). The pitch classes and the notes in each line to which a value "1" is given, are chord notes composing the scale corresponding to the line. The pitch classes and the notes in each line to which a value "0" is given are not notes composing the scale corresponding to the line. In the present embodiment, for simplicity of the process and for insurance of stability, the scale notes in the scales of (a) major, (b) hminor and (c) mminor in FIG. 10 are not to be compared, but scale notes in an integrated scale of the above scales (hereinafter, the "integrated scale") shown at (d) in FIG. 10 are to be compared. The scale notes in the integrated scale (d) in FIG. 10 or notes not composing the scale are obtained by implementing a logical sum operation on the scale notes in the scales of (a) major, (b) hminor and (c) mminor in FIG. 10 or the notes not composing the scale for each pitch class (note). In other words, when a value of the scales of (a) major, (b) hminor and (c) mminor in FIG. 10 is "1", then a value of the (d) integrated scale will be "1". When a value of the scales of (a) major, (b) hminor and (c) mminor in FIG. 10 is "0", then a value of the (d) integrated scale will be "0". The ROM 102 in FIG. 1 stores array constants scale[i] corresponding to the (d) integrated scale in FIG. 10, determined when the key value is the pitch class=0 (note=C). A value "i" represents a value of the pitch class in FIG. 10 and takes a value from 0 to 11, and an array element value scale[i] stores a value 1 or 0 on the line of the integrated scale (d) in each pitch class "i" in FIG. 10. The CPU 101 calculates a value of [(12+iPc−ikey) %12] (step S905). In the calculation of [(12+iPc−ikey) %12], the CPU 101 determines to which pitch class a difference between the pitch class iPC designated at step S904 and the key value ikey designated at step S902 corresponds. To keep a value of (12+iPc−ikey) positive, 12 is added in the calculation within the round brackets. A symbol "%" indicates the modulo operation for finding a reminder. The CPU 101 uses a result of the calculation as an array element parameter and reads from the ROM 102 an array element value scalenote[(12+iPc−ikey) %12] and judges whether the array element value is 1 or not. In this way, the CPU 101 can judges whether the pitch class iPc designated at step S904 is included in the scale notes in the integrated scale with the key value equivalent to a key value designated at step S902, to which integrated scale an integrated scale set when the key value shown at (d) in FIG. 10 is the pitch class=0 (note=C) is transferred.

When it is determined that the current pitch class iPc designated at step S904 is included in the scale notes in the integrated scale corresponding to the current key value designated at step S902 (YES at step S905), the CPU 101 accumulates the pitch class power IPitchClassPower[iPc] calculated with respect to the pitch class iPc at step S901 to obtain the first power evaluation value IPower (step S906). In the process at step S906 in FIG. 9, the symbol of operation "+=" indicates an operation of accumulating values on the right side to a value on the left side. The symbol of "+=" at step S1406, and step S1407 in FIG. 14 has the same meaning.

Meanwhile, when it is determined that the current pitch class iPc designated at step S904 is not included in the scale notes in the integrated scale corresponding to the current key value designated at step S902 (NO at step S905), the CPU 101 accumulates the pitch class power IPitchClassPower [iPc] calculated with respect to the pitch class iPc in the process at step S901 to obtain the second power evaluation value IOtherPower (step S907).

After having executed the processes at step S905 to step S907 with respect to all the values from 0 to 11 of the pitch class iPc (the judgment at step S904 finishes), the CPU 101 divides the first power evaluation value IPower by the second power evaluation value IOtherPower to obtain a quotient as the power evaluation value doKeyPower corresponding to the current key value ikey designated at step S902 (step S908). When the process is executed at step S908, the first power evaluation value IPower indicates to what degree of strength the scale notes in the integrated scale corresponding to the current key value ikey designated at step S902 are sounding. The second power evaluation value IOtherPower indicates to what degree of strength the notes other than the scale notes in the integrated scale corresponding to the key value ikey are sounding. Therefore, the power evaluation value doKeyPower obtained by calculating "IPower/IOtherPower" is an index indicating to what degree the currently sounding notes in the current frame are similar to the scale notes in the integrated scale corresponding to the current key value ikey.

The CPU 101 compares the power evaluation value doKeyPower corresponding to the current key value ikey calculated at step S908 with the power evaluation maximum value doMax corresponding to the key value being designated just before (step S909). When the power evaluation value doKeyPower is not smaller than the power evaluation maximum value doMax, the CPU 101 replaces the power evaluation maximum value doMax and the power evaluation maximum key value imaxkey with the current power evaluation value doKeyPower and the key value ikey, respectively (step S910). Then, the CPU 101 returns to the process at step S902, and executes the process for the following key value ikey.

Figure 11:
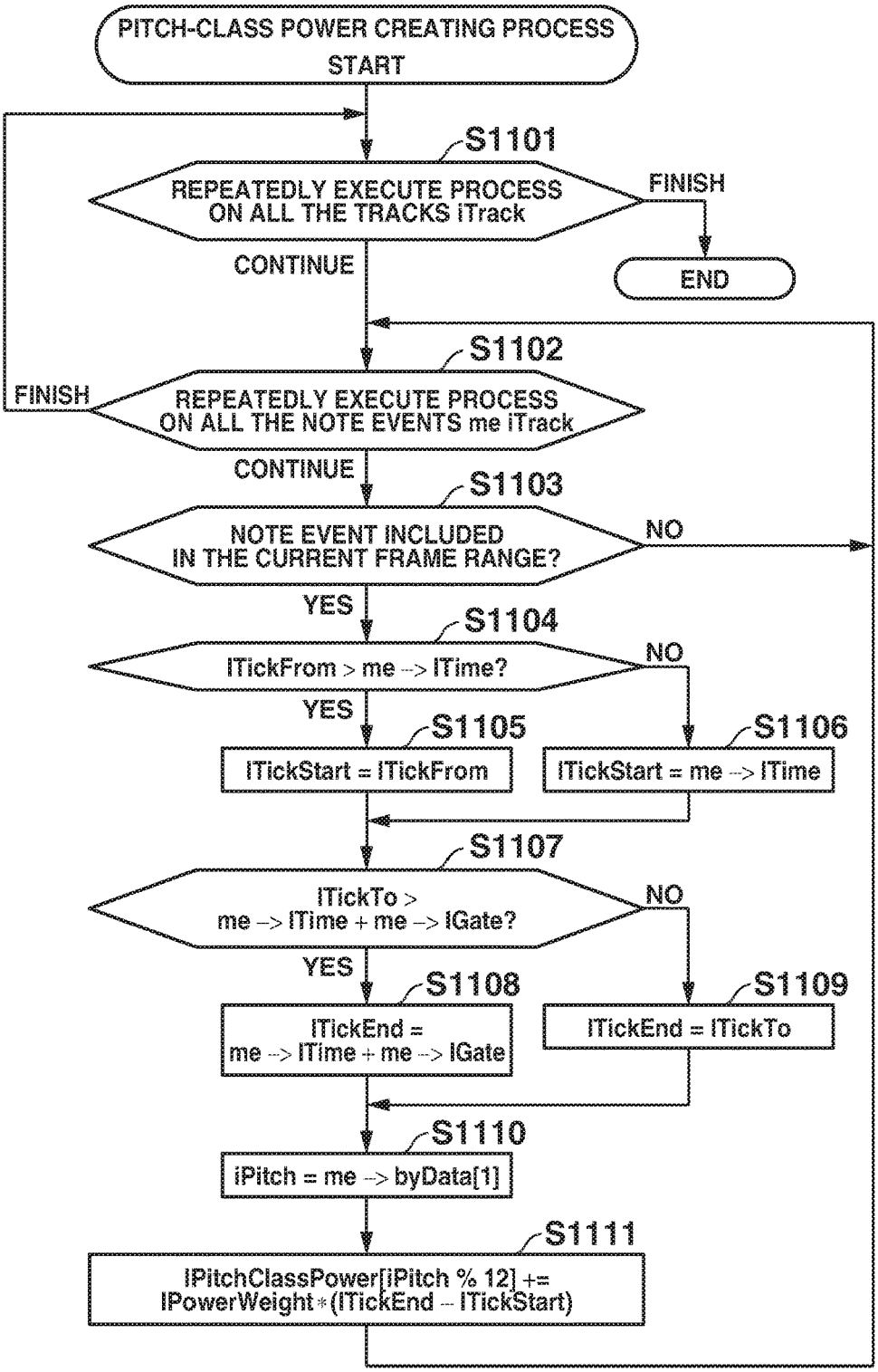
FIG. 11 is a flow chart of an example of a pitch class power creating process.

FIG. 11 is a flow chart of an example of a pitch class power creating process. The CPU 101 repeatedly executes a series of processes (step S1102 to step S1111) on all the tracks in the MIDI sequence data (having a data format shown in FIG. 2A) read on the RAM 103 at step S404 in FIG. 4 (step S1101). The CPU 101 sequentially designates the track numbers of the tracks memorized on the RAM 103 (step S1101). The CPU 101 refers to pointer information midiev[iTrack] corresponding to the track number iTrack in the MIDI sequence data shown in FIG. 2A to access the first note event memorized at a part of the RAM 103 corresponding to the track number iTrack.

The CPU 101 refers to the next pointer shown FIG. 2A in the note event to sequentially follow the note events from the first note event, executing a series of processes (step S1103 to step S1111) on all the note events in the parts of the track number iTrack (step S1102). The pointer introducing the current note event will be expressed as "me". Reference to data in the current note event, for instance, reference to the sounding start time ITime will be described as "me-->ITime".

The CPU 101 judges whether the current note event designated at step S1102 is involved in the frame (hereinafter, the "current frame range") beginning from the starting measure designated at step S602 and having the frame length such as 1-measure frame length, 2-measure frame length, or 4-measure frame length, determined at step S601 in FIG. 6 (step S1103). The CPU 101 calculates the leading time of the current frame range counted from the head of the musical piece and stores the calculated leading time as a variable or a current frame range starting time iTickFrom in the RAM 103. As described above, "tick" is used as a unit of time for the beat and the measure. In general, one beat is 480 ticks, and in the case of a musical piece of a four-four meter, one measure has a length of four beats. Therefore, in the case of a musical piece of a four-four meter, when the measure number of the starting measure of the frame designated at step S602 in FIG. 6 is counted from the head or 0-th measure of the musical piece, the start time of the starting measure of the frame will be given by (480 ticks×4 beats×the measure number of the starting measure of the frame), which will be calculated as the current frame range starting time iTickFrom. Similarly, the CPU 101 calculates a finishing time of the current range counted from the head of the musical piece, and stores the calculated finishing time as a variable or a current frame range finishing time iTickTo in the RAM 103. The current frame range finishing time iTickTo will be given by the current range starting time iTickFrom+(480 ticks×4 beats×the frame length designated at step S601). Further, the CPU 101 refers to the pointer "me" of the current note event to access the sounding start time ITime and the sounding time length IGate of the current note event (both, refer to FIG. 2A), and decides the sounding frame of the current note event based on the sounding starting time ITime and the sounding time length IGate of the current note event, and judges which relationship with respect to the current frame range starting time iTickFrom and the current range finishing time iTickTo the sounding frame of the current note event holds 1201, 1202, or 1203 shown in FIG. 12. When the sounding frame of the current event holds either of the relationships 1201, 1202, and 1203, it will be decided that sounding of the note event designated at present is involved in the current range. When this is true, the CPU 101 decides YES at step S1103. More specifically, when the current frame range finishing time iTickTo comes after the sounding start time "me-->ITime" of the current note event, and the current frame range starting time iTickFrom comes before the sounding finishing time of the current note event (the sounding starting time "me-->ITime"+the sounding time length "me-->IGate"), then the judgment at step S1103 is YES.

When it is determined NO at step S1103, the CPU 101 determines that the current note event is not involved in the current frame range, and returns to the process at step S1102 to execute the process on the following note event.

When it is determined YES at step S1103, the CPU 101 judges whether the current frame range starting time iTickFrom comes after the sounding starting time "me-->ITime" of the current note event (step S1104).

When it is determined YES at step S1104, since the current frame range starting time iTickFrom comes after the sounding starting time "me-->ITime" of the current note event (the state of 1201 in FIG. 12), the CPU 101 sets the current frame range starting time iTickFrom to the sounding start time ITickStart in the current frame range of the current event stored in the RAM 103 (step S1105).

Figure 12:
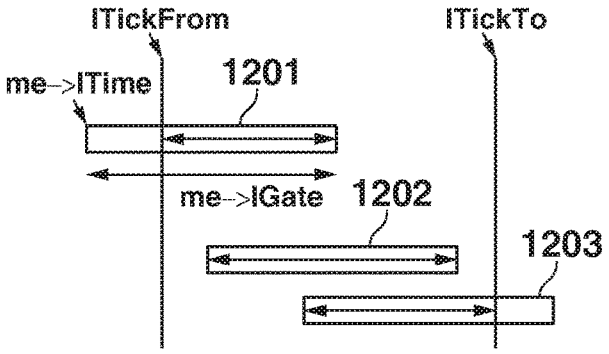
FIG. 12 is a view for explaining the pitch class power creating process.

Meanwhile, when it is determined NO at step S1104, it is determined that the current frame range starting time iTickFrom is in the state of 1202 or 1203 in FIG. 12. Then, the CPU 101 sets the sounding starting time "me-->ITime" of the current note event to the sounding start time ITickStart in the current frame range of the current event stored in the RAM 103 (step S1106).

After having executed the process at step S1105 or at step S1106, the CPU 101 judges whether the current frame range finishing time iTickTo comes after the sounding finishing time of the current note event (the sounding start time "me-->ITime"+the sounding time length "me-->IGate") (step S1107).

When it is determined YES at step S1107, it is determined that the current frame range finishing time iTickTo comes after the sounding finishing time of the current note event (the state of 1201 or 1202 in FIG. 12). Then, the CPU 101 sets the sounding finishing time of the current note event (the sounding starting time "me-->ITime"+the sounding time length "me-->IGate") to the sounding finishing time ItickEnd in the current frame range of the current note event stored in the RAM 103 (step S1108).

When it is determined NO at step S1107, it is determined that the current frame range finishing time iTickTo comes before the sounding finishing time of the current note event (the state of 1203 in FIG. 12). Then, the CPU 101 sets the current range finishing time iTickTo to the sounding finishing time ItickEnd in the current frame range of the current note event stored in the RAM 103 (step S1109).

After having executed the process at step S1108 or at step S1109, the CPU 101 accesses the pitch byData[1] (Refer to FIG. 2A) through the pointer "me" of the current note event and sets the pitch byData[1] to the pitch iPitch of the current note event in the RAM 103 (step S1110).

The CPU 101 divides the pitch iPitch of the current note event by 12, finding a reminder [iPitch %12] to calculate a pitch class of the current note event, and stores the following calculated value to a pitch class power IPichClassPower [iPitch %12] of the pitch class stored in the RAM 103. The CPU 101 multiplies velocity information IPowerWeight decided based on a velocity and part information of the current note event by a sounding time length (ITickEND−ITickStart) in the current frame range of the current note event to obtain the pitch class power IPichClassPower[iPitch %12]. For instance, the velocity information IPowerWeight is obtained by multiplying the velocity me-->byData[2] (Refer to FIG. 2A) referred through the pointer "me" of the current event by a predetermined part coefficient (stored at a part of the ROM 102 which part is previously defined for the part corresponding to the number of the current track iTrack (Refer to step S1101). The longer the sounding time of the current note event is and the larger the velocity of the current note is in the current frame range, a larger configuration ratio in the current frame range the pitch class power IPichClassPower[iPitch %12] corresponding to the current note event shows in accordance with the part to which the current note event belongs.

After having executed the process at step S1111, the CPU 102 returns to the process at step S1102 and performs the process on the following note event.

When a series of processes (step S1103 to step S1111) have been repeatedly executed and the processes have finished on all the note events "me" corresponding to the current track number iTrack, then the CPU 101 returns to the process at step S1101 and executes the process on the following track number iTrack. Further, when the processes at step S1102 to step S1111 have been repeatedly executed and the processes have finished on all the track numbers iTrack, then the CPU 101 finishes the pitch class power creating process (step S901 in FIG. 9) shown by the flow chart in FIG. 11.

Figure 13:
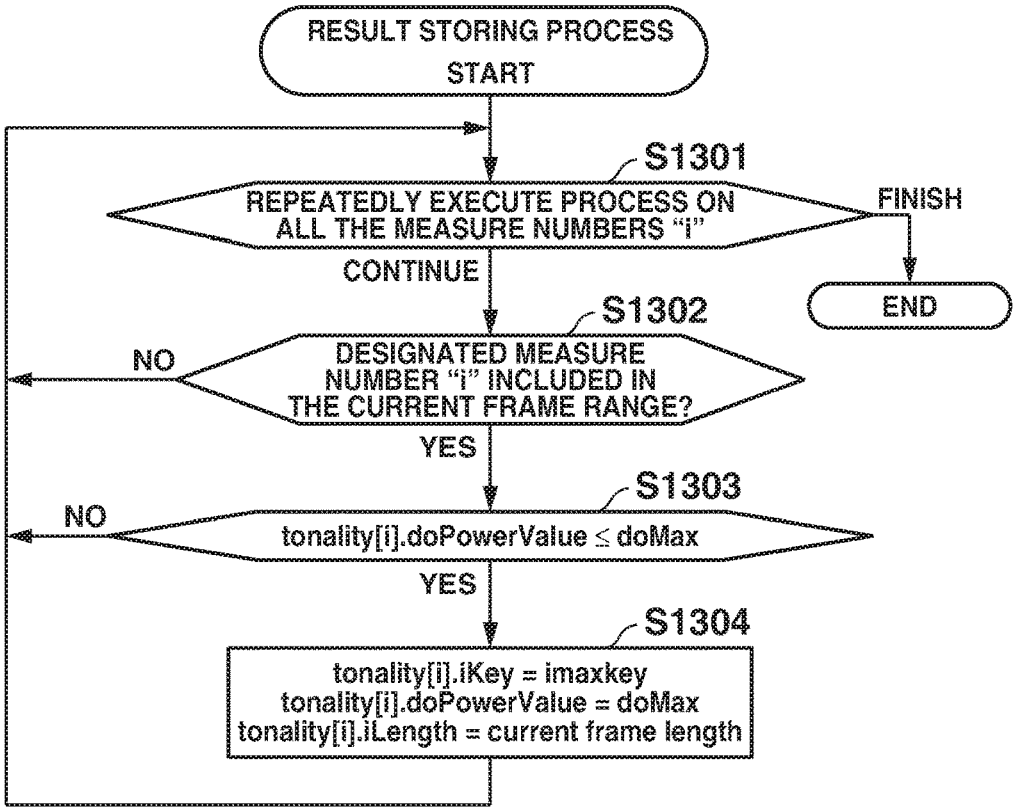
FIG. 13 is a flow chart of a detailed result storing process in the flow chart of the tonality judging process of FIG. 6.

FIG. 13 is a flow chart of the result storing process at step S604 in the flow chart of the tonality judging process in FIG. 6. The CPU 101 compares the power evaluation value doKeyPower calculated with respect to the current frame range (the frame having the frame length decided a step S601 and starting from the starting measure designated at step S602) in the key judging process at step S603 in FIG. 6 with the power evaluation value calculated with respect to the other the frame length which overlaps with the current frame range, thereby deciding the optimum tonality in the frame at present.

The CPU 101 repeatedly executes a series of processes (step S1302 to step S1303) on every measure composing the musical piece (step S1301). In the process at step S1301, the CPU 101 gives the leading measure of the musical piece the measure number of "0" and successively gives the following measures the consecutive number "i".

The CPU 101 judges whether the measure number "i" is included in a group of the measure numbers from the measure number of the starting measure of the frame designated at step S602 to the current frame range of the frame length designated at step S601 in FIG. 6 (step S1302).

When it is determined NO at step S1302, the CPU 101 returns to the process at step 1301, and executes the process on the following measure number.

When it is determined YES at step S1302, the CPU 101 judges whether the power evaluation value doKeyPower which is calculated for the current frame range in the key judging process at step S603 in FIG. 6 is not less than the power evaluation value tonality[i].doPower included in the tonality information (of the data format shown in FIG. 2B) stored in RAM 103, which evaluation value is referred to through the pointer information tonality[i] corresponding to the measure number "i" (step S1303).

When it is determined NO at step S1303, the CPU 101 returns to the process at step 1301, and executed the process on the following measure number.

When it is determined YES at step S1303, the CPU 101 sets the power evaluation maximum key value imaxkey calculated in the process at step S910 in FIG. 9 to the key of tonality tonality[i].iKey in the tonality information referred to through the pointer information tonality[i] corresponding to the measure number "i". Further, the CPU 101 sets the power evaluation maximum value doMax calculated at step S910 in FIG. 9 to the power evaluation value tonality[i].doPowerValue obtained when the tonality is judged. Furthermore, the CPU 101 sets the current frame length designated at step S601 in FIG. 6 to the frame length tonality[i].iLength used when the tonality is judged (step S1304). After executing the process at step S1304, the CPU 101 returns to the process at step 1301 and executes the process on the following the measure number.

The tonality data is initially created and stored in the RAM 103 as shown in FIG. 2B, from pointer information for the required number of measures in note events of the MIDI sequence data and tonality information accessed to through the pointer information, wherein the MIDI sequence data is read in the RAM 103 when a musical piece is read at step S404. For example, in the case of a musical piece of a four-four meter, assuming that one beat is 480 ticks, the required number N of measures N=((ITime+IGate)/480/4 beats of the ending note event in FIG. 2A) is calculated. As a result, the pointer information from tonality[0] to tonality [N−1] is created and structure data of the tonality information (shown in FIG. 2B) referred to through the pointer information is created. In the structure data referred to through the pointer information tonality[i] ($0 \le i \le N-1$), an ineffective value is initially set to tonality[i].iKey. For instance, a negative value is set to tonality[i].doPowerValue. A time value of (480 ticks×4 beats×i measure) ticks is set to tonality[i]. ITick. The measure number "i" is set to tonality [i].iMeasNo. In the present embodiment, tonality[i].iScale is not used.

As shown in FIG. 8, in the result obtained in the tonality judging process, when the frame length designated at step S601 in FIG. 6 is the 1-measure frame length (iFrameType=0) and the measure number of the starting measure in the frame designated at step S602 is 0 (iMeasNo=0 at (a) in FIG. 8), the pitch class=10 (note=B♭) is obtained as the power evaluation maximum key value imaxkey, and the power evaluation maximum value doMax 3 is obtained (Refer to (c) in FIG. 8). As a result, in the flow chart of the result storing process (step S604 in FIG. 6) shown in FIG. 13, when the measure number i=0, the judgment made at step S1302 will be YES. The judging process is executed at step 1303, since the initial value of the tonality[0].doPowerValue is negative, it is determined that the power evaluation maximum value doMax=3 is larger (YES at step S1303). At step S1304, tonality[0].iKey=imaxkey=10 (note=B♭), tonality[0].doPowerValue=doMax=3, tonality [0].iLength=1 (1-measure frame length) are set.

Further, in the result obtained in the tonality judging process shown in FIG. 8, when the frame length designated at step S601 in FIG. 6 is the 2-measure length (iFrameType=1), and the measure number of the starting measure designated at step S602 is 0 (iMeasNo=0 at (a) in FIG. 8), as a result of the key judging process at step S603, the pitch class=10 (note=B♭) is obtained as the power evaluation maximum key value imaxkey, and the power evaluation maximum value doMax 4 is obtained, as shown at (d) in FIG. 8. As a result, in the flow chart of the result storing process (step S604 in FIG. 6) shown in FIG. 13, when the measure number i=0, the judgment made in the process at step S1302 will be YES. The judging process is executed at step 1303, since the tonality[0].doPowerValue=3, it is determined that the power evaluation maximum value doMax=4 is larger (YES at step S1303). At step S1304, tonality[0].iKey=imaxkey=10 (note=B♭), tonality[0].doPowerValue=doMax=4, tonality[0].iLength=2 (measure length) are set.

Furthermore, as will be understood from the result obtained in the tonality judging process shown in FIG. 8, when the frame length designated at step S601 in FIG. 6 is the 4-measure length (iFrameType=2) and the measure number of the starting measure designated at step S602 is 0 (iMeasNo=0 at (a) in FIG. 8), the pitch class=0 (note=C) is obtained as the power evaluation maximum key value imaxkey and the power evaluation maximum value doMax 7 is obtained in the key judging process at step S603, as shown at (e) in FIG. 8. As a result, in the flow chart of the result storing process (step S604 in FIG. 6) shown in FIG. 13, when the measure number i=0, the judgment made in the process at step S1302 will be YES. The judging process is executed at step 1303, since the tonality[0].doPowerValue=4, it is determined that the power evaluation maximum value doMax=7 is larger and it is determined YES at step S1303. At step S1304, tonality[0].iKey imaxkey=10 (note C), tonality[0].doPowerValue=doMax=7, tonality[0].iLength=4 (measure length) are set.

When the series of processes (step S1302 to step S1304) have been executed on all the measure numbers "i" composing the musical piece, the CPU 101 finishes the result storing process (step S604 in the flow chart of FIG. 6) shown in FIG. 13.

As will be understood from the result obtained in the tonality judging process shown in FIG. 8, in the present embodiment even if the chords are modulated or when there is no sounding enough for judging a chord only in 1-measure frame length, the comprehensive judgment on the result of the tonality judgment made on the plural frame lengths (iTrameType) will allow an appropriate decision of tonality. Further, in the present embodiment, since a note other than the chord composing notes is taken into consideration when the power evaluation value is calculated, the enhanced precision of tonality judgment can be maintained. Furthermore, in the present embodiment, the first power evaluation value IPower relating to the scale notes of the tonality and the second power evaluation value IOtherPower relating to notes other than the scale notes are calculated in the processes at step S906 and at step S907 in FIG. 9, respectively, and the power evaluation value doKeyPower corresponding to the key value ikey is calculated based on the first and the second value. Therefore, both the scale notes of the tonality and the notes other than the scale notes are taken into consideration to make power evaluation with respect to the key value ikey of tonality, and as a result the precision of judgment can be maintained.

The pitch-class power creating process (step S504) and the matching and result storing process (step S505) will be described in detail. The pitch-class power creating process (step S504) and the matching and result storing process (step S505) are repeatedly executed on every measure in the musical piece (step S502) and on each beat in the every measure (step S503) after the appropriate tonality in each measure of the musical piece has been judged in the tonality judging process at step S501 in FIG. 5.

The pitch-class power creating process (step S504 in FIG. 5) will be described in detail. The CPU 101 decides a power information value of every note event to be made note-on within the beat set at present in the musical piece, based on the velocity of the note event and the sounding time length in the beat, and accumulates the power information values in each of pitch classes corresponding respectively to the pitches of the notes to calculate a power information accumulating value of each pitch class in the current beat.

The detailed process at step S504 in FIG. 5 is shown in the flow chart of FIG. 11. In the detailed description of the process (step S901 in FIG. 9) in FIG. 11, the "current frame range" was the measure frame which is currently designated for performing the tonality judgment, but in the following description of the process (step S504 in FIG. 5) in FIG. 11, the "current frame range" is the range corresponding to the beat designated at step S503 in the measure designated at step S502 in FIG. 5. The current frame range starting time iTickFrom in FIG. 12 is the starting time of the current beat. As described above, the "tick" is used as the unit of time with respect to the beat and the measure. In general, one beat is 480 ticks, and in the case of a musical piece of a four-four meter, one measure has four beats. Therefore, in the case of the musical piece of a four-four meter, when the measure number of the measure designated at step S502 in FIG. 5 is counted form the head or 0-th measure of the musical piece, the starting time of the measure will be given by (480 ticks×4 beats×the measure number). Further, when the beat number of the beat designated at step S502 in FIG. 5 is counted from the leading beat 0 in the measure, the starting time of the beat in the measure will be given by (480 ticks×the beat number). Therefore, the current frame range starting time iTickFrom will be given by (480 ticks×4 beats×the measure number)+(480 ticks×the beat number)=480×(4 beats×the measure number+the beat number). The current frame range finishing time iTickTo in FIG. 12 is the finishing time of the current beat. Since 1 beat is 480 ticks, the current frame range finishing time iTickTo will be given by the current range starting time iTickFrom+480=480×(4 beats×the measure number+the beat number+1).

After the replacement of the above variables, the CPU 101 executes the processes in accordance with the flow chart shown in FIG. 11. At step S1111, the CPU 101 divides the pitch iPitch of the current note event by 12, finding a reminder (iPitch %12) corresponding to the pitch class power IPitchClassPower[iPitch %12] in the pitch class of the current note event, and stores the following calculated value to the pitch class power IPitchClassPower[iPitch %12]. The CPU 101 multiplies the velocity information IPowerWeight decided based on the velocity and the part information of the current note event by the sounding time length (ITickEnd−ITickStart) to obtain the pitch class power IPichClassPower[iPitch %12]. When the sounding time of the current note event is longer in the current beat range and also the velocity of the current note is larger, then the pitch class power IPichClassPower[iPitch %12] of the current note event will indicate the larger composing ratio in the current beat range of the note of the pitch class [iPitch %12] of the current note event in accordance with the part to which the current note event.

Figure 14:
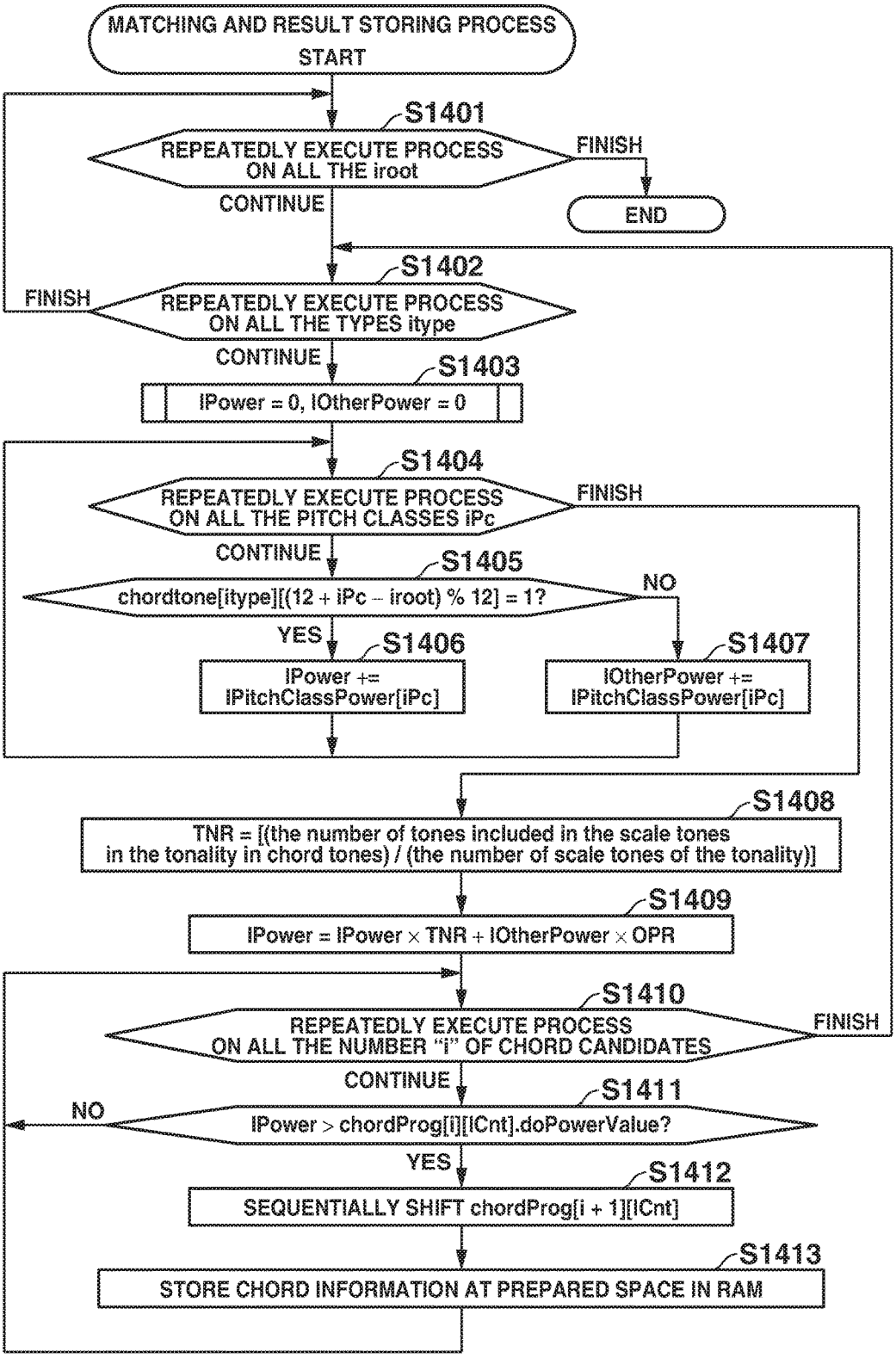
FIG. 14 is a flow chart of an example of a matching and result storing process in the chord judging process of FIG. 5.

FIG. 14 is a flow chart of an example of the matching and result storing process at step S505 in FIG. 5.

The CPU 101 executes a series of processes (step S1402 to step S1413) with respect to all the values iroot from 0 to 11, each indicating the root (fundamental note) of a chord (step S1401). The CPU 101 executes a series of processes (step S1403 to step S1413) with respect to all the chord types itype indicating types of chords (step S1402).

While repeatedly executing the processes (step S1403 to step S1413), the CPU 101 clears the first power evaluation value IPower and the second power evaluation value IOtherPower to "0" (step S1403).

The CPU 101 executes processes at step 1405 to step 1407 on all the pitch classes iPC from 0 to 11 (step S1404).

The CPU 101 judges whether the current pitch class iPc designated at step S1404 is included in the chord tones of the chord decided based on the chord root iroot designated at step S1401 and the chord type itype designated at step S1402 (step S1405). The judgment at step S1405 is made based on whether "chordtone[itype][(12+iPc−iroot) %12]" is 1 or not. FIG. 15 is a view for explaining the chord tones. In FIG. 15, each value given on the lines of (a) major, (b) minor, (c) 7th, and (d) minor 7th indicates the pitch class and the tone (note) of the chord tone (chord note) in each of the chord types of the major chord, the minor chord, the 7th chord and the minor 7th chord, in the case that the chord root is "pitch class=0" (note=C). The pitch class and the note indicated by the value of "1" on the line compose the chord tone of the chord corresponding to said line. The pitch class and the note which are given the value of "0" mean that a note other than the chord note of the chord corresponding to the line is to be compared. The ROM 102 (in FIG. 1) stores array constants chordtone[itype][i] corresponding respectively to the chord types of (a) the major chord, (b) the minor chord, (c) the 7th chord and (d) the minor 7th chord shown in FIG. 15, in the case that the chord root is the pitch class=0 (note=C). In practice, the types of itype are more than 4 types as shown in FIG. 15. In FIG. 15, the pitch class "i" takes a value from 0 to 11, and a value "1" or "0" in the pitch class "i" corresponding to the second array element parameter "i" on the lines of (a) the major chord, (b) the minor chord, (c) the 7th chord or (d) the minor 7th chord (FIG. 15) corresponding to the first arranging element parameter itype is set to the array element value chordtone[itype][i]. The CPU 101 calculates "(12+iPc−iroot) %12" to obtain the second arranging element parameters (step S1405). In the calculation, it is calculated, to which pitch class the difference between the pitch class iPc designated at step S1404 and the chord root iroot designated at step S1401 corresponds. To keep a value of (12+iPc−iroot) positive, 12 is added in the calculation of the bracketed numerical expression. The symbol "%" indicates the modulo operation for obtaining a reminder. The CPU 101 refers to the calculated second array element parameter and the first array element paramenter itype designated at step S1402 to judge whether the array element value chordtone[itype][12+iPc−iroot]%12] is 1 or not. In this way, the CPU 101 can judge whether the pitch class iPc designated at step S1404 is involved in the chord tones on the line corresponding to the chord type itype when the chord tones with the chord root in the pitch class=0 (note=C) (shown in FIG. 15) are transferred to the chord tones with the chord root iroot designated at step S1401.

When the current pitch class iPc designated at step S1404 is involved in the chord tones of the chord corresponding to the current chord type itype designated based on the iroot designated at step S1401 and the current chord type itype designated in the process at step S1402 (YES step S1405), the CPU 101 accumulates the pitch class power IPichClassPower[iPc] calculated at step S504 in FIG. 5, corresponding to the pitch class iPc to obtain the first power evaluation value IPower (step S1406).

Meanwhile, when the current pitch class iPc designated in the process at step S1404 is not involved in the chord tones of the chord corresponding to the current chord type itype designated based on the iroot designated in the process at step S1401 and the current chord type itype designated in the process at step S1402 (NO step S1405), the CPU 101 accumulates the pitch class power IPichClassPower[iPc] calculated in the process at step S504 in FIG. 5, corresponding to the pitch class iPc to obtain the second power evaluation value IOtherPower (step S1407).

When having executed the processes at step S1405 to step 1407 on all the pitch class iPc from 0 to 11 (FINISH at step S1407), the CPU 101 executes the following process. The CPU 101 decides a chord based on the chord root iroot and the chord type itype designated at present respectively at step S1401 and at step S1402 to determine the chord tones of the decided chord, and then divides the number of tones included in the scale tones in the tonality decided in the tonality judging process (step S501 in FIG. 5) executed on the measure designated at present at step S502 by the number of scale tones in the tonality, thereby obtaining a compensation coefficient TNR in the chord tones of the decided chord. That is, the CPU 101 performs the following operation (1) (step S1408).

$$\text{TNR}=(\text{the number of tones included in the scale tones in the tonality in chord tones})/(\text{the number of scale tones of the tonality}) \quad (1)$$

More specifically, the CPU 101 uses the measure number of the measure designated at present at step S502 in FIG. 5 as a parameter to access the tonality information (shown in FIG. 2B) stored in the RAM 103 through the pointer information tonality[measure number] (having a data format, FIG. 2B). In this way, the CPU 101 obtains a key value tonality[measure number].iKey of the above measure. The CPU 101 transfers the scale tones (stored in the ROM 10) in each scale[i] corresponding respectively to array constants in the (d) integrated scale (FIG. 10) in accordance with the obtained key value tonality[measure number].iKey, wherein the (d) integrated scale is integrated when the key value is pitch class=0 (note=C). In this way, the CPU 101 obtains information of the scale tones in the integrated scale corresponding to the obtained key value tonality[measure number].iKey. The CPU 101 compares the scale tones with the chord tones in the chord decided based on the chord root and chord type designated at present respectively at step S1401 and at step S1402 to calculate the above equation (1).

For instance, when the tonality judgment results in a C major, compensation values in chords will be as follows: G7: 1, B dim: 1, B dim7: 0.75, B m7♭5=1.0, D dim7=0.75, F dim7=0.75

Further, the CPU 101 multiplies the first power evaluation value IPower calculated at step S1406 by the compensation coefficient TNR calculated at step S1408, and multiplies the second power evaluation value IOtherPower by a predetermined negative constant OPR, and then adds both the products to obtain the sum. Then, the CPU 101 sets the sum to the first power evaluation value IPower, thereby calculating a new power evaluation value IPower for the chord decided based on the chord root and the chord type designated at present respectively at step S1401 and at step S1402 (step S1409).

In the present embodiment, usage of the compensation coefficients TNR (1) will make the tonality judgment made on each measure in the tonality judging process (step S501 in FIG. 5) reflect on the chord judgment on each beat in the measure, whereby a precise chord judgment is assured.

The CPU 101 repeatedly executes a series of processes (step S1411 to step S1413) on all the number "i" (i=0, 1, 2, . . . ) of chord candidates corresponding to the beat number ICnt of the current beat in the chord progressing data shown in FIG. 3 (step S1410).

In the repeatedly executed processes, the CPU 101 obtains a power evaluation value chordProg[ICnti][i] doPowerValue in the chord information referred to by the pointer information chorProg[ICnt][i] of the (i+1)th candidate (if i=0, the first candidate, if i=1, the second candidate, and if i=2, the third candidate, . . . ) corresponding to the current beat number ICnt. The current beat number ICnt is the consecutive beat number counted from the leading part of the musical piece. In the case of the musical piece of a four-four meter, the beat number ICnt is given by (4 beats× the measure number at step S502)+(the beat number at step S503). The CPU 101 judges whether the power evaluation value IPower calculated at step S1409 is larger than the above power evaluation value chrodProg[ICnt][i].doPowerValue (step S1411).

When it is determined NO at step S1411, the CPU 101 returns to the process at step S1410 and increments "i" and executes the process on the following chord candidate.

When it is determined YES at step S1411, the CPU 101 sequentially accesses the chord information which are referred to by the pointer information chordProg[i+1][ICnt], pointer information chordProg[ICnt][i+2], pointer information chordProg[ICnt][i+3], . . . , and so on (step S1412). Then the CPU 101 stores the chord information (having the data format shown in FIG. 3) referred to by the i-th pointer information chordProg[ICnt][i] in a storage space prepared in the RAM 103 (step S1413).

In the chord information, ITick stores a starting time of the current beat (decided at step S503) in the current measure decided at step S502. The starting time of the current beat corresponds to the current frame range starting time iTickFrom=480×(4 beats×the current measure number+the current beat number in the measure), as described in the description of the pitch class power creating process at step S504 in FIG. 5. iMeansNo stores the measure number of the current measure counted from the head (the 0-th measure) of the musical piece. iTickInMeas stores a starting tick time of the current beat in the measure. As described in FIG. 2B, iTickInMeas stores either of a tick value 0 of the first beat, 480 of the second beat, 960 of the third beat or 1440 of fourth beat. iRoot stores the current chord root iroot-value designated at step S1401. iType stores the current chord type designated at step S1402. doPowerValue stores a power evaluation value calculated at step S1409. Thereafter, the CPU 101 returns to the process at step S1410 and executes the process on the following chord candidate.

After having finished executing the process on all the chord candidates (FINISH at step S1410), the CPU 101 returns to the process at step S1402 and executes the repeating process with respect to the following chord type itype.

After having finished executing the repeating process with respect to all the chord types itype (FINISH at step S1402), the CPU 101 returns to the process at step S1401 and executes the repeating process with respect to the following chord root iroot.

After having finished executing the repeating process with respect to all the chord roots iroot (FINISH at step S1401), the CPU 101 finishes the matching and result storing process (step S505 in the flow chart in FIG. 5) shown in FIG. 14.

A minimum cost calculating process at step S506 in FIG. 5 and a route deciding process at step 507 in FIG. 5 will be described in detail. In judging chords of music data, an influence of tones other than chord tones actually used in the musical piece and/or silence of chord tones can often prevent an appropriate chord judgment. For instance, in the case of sounding of only tones of ti, re, fa (solfa syllables), the chords having these tones as the chord tones are G7, B dim, B dim7, B m7♭5, D dim7, and Fdim7. In the case of sounding of only tones of do, do♯, re, mi♭, mi (solfa syllables), the chords having these tones as a part of the chord tones are C add9, C madd9 and C♯mM7. When there are plural chord candidates including these chords, it is hard to judge a chord only from the pitch class at the beat timing when such chord exists, and it will be required a device using musical knowledge and taking into variable elements on a temporal axis.

In general, there are musical and natural rules in connection of chords before and/or behind notations of "sus4" and "mM7". For example, in most cases the chord placed after the notation of "sus4" has the same chord root as the preceding chord, and the chords placed before and/or behind notation of "mM7" have the same chord root and are minor chords.

In the present embodiment, a cost of connection between two chords is defined based on a musical connection rule. At step S506 in FIG. 5 the CPU 101 finds the combination of chords which shows the minimum connection cost throughout the musical piece, from among all the combinations of chord progressing data, the chord progressing data consisting of plural candidates (of data format in FIG. 3) in all the beats of the measure and in all the measures of the musical piece. For calculation of the minimum cost, for instance, Dijkstra's algorithm can be used.

Figure 16A:
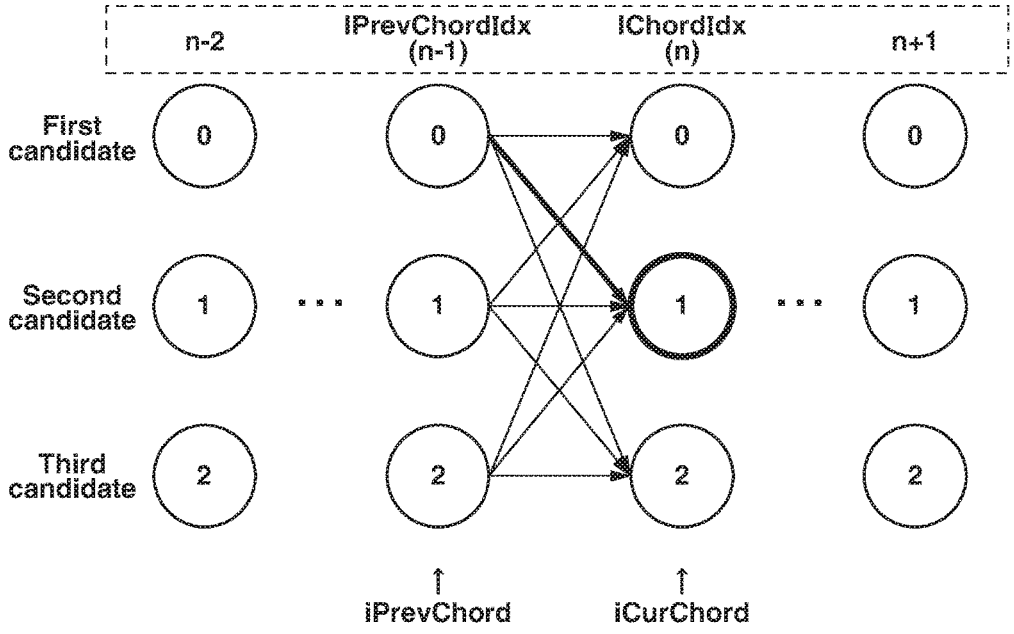
FIG. 16A is a view for explaining a minimum cost calculating process.
Figure 16B:
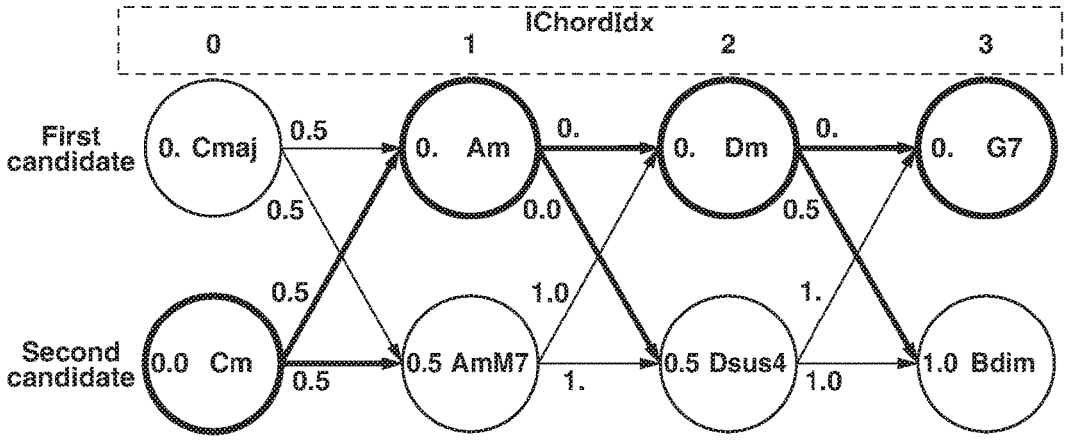
FIG. 16B is a view for explaining a route confirming process.

FIG. 16A and FIG. 16B are views for explaining a minimum cost calculating process and a route confirming process. FIG. 16A is a view for explaining a route optimizing process in the minimum cost calculating process. FIG. 16B is a view for explaining a route optimized result in the minimum cost calculating process and the route confirming process. Assuming that "m" units of candidates for the chord are found at each beat timing (for instance, 3 candidates), the route optimizing process is executed in the minimum cost calculating process at step S506 to find a route of the minimum cost from among combination of (the number of beats)-th power of m (the number of chords). Hereinafter, the case of m=3 will be described.

As shown in FIG. 16A, in the chord progressing data (FIG. 3), three candidates from the first to third candidate are obtained respectively at beat timings, n−2, n−1, n, and n+1. Assuming that the beat timing "n" is the current beat timing, the current beat timing is designated by a variable IChordIdx stored in the RAM 103. Further, the next preceding beat timing "n−1" is designated by a variable IPreChordIdx stored in the RAM 103. Furthermore, the candidate number (0, 1, or 2) of the candidate at the current beat timing "n" designated by the variable IChordIdx is designated by a variable iCurChord stored in the RAM 103. Further, the candidate number (0, 1, or 2) of the candidate at the next preceding beat timing "n−1" designated by the variable IPreChordIdx is designated by a variable iPrevChord stored in the RAM 103.

In the minimum cost calculating process executed in the present embodiment, the total cost needed during a term from a time of start of sounding of a chord at the timing of the leading beat of the musical piece to a time of sounding of the chord candidate of the chord number iCurChord currently selected at the timing of the current beat IChordIdx after chord candidates are successively selected at each beat timing is defined as the optimum chord total minimum cost doOptimizeChordTotalMinimalCost[IChirdIdx], array variables to be stored in the RAM 103. Then, the optimum chord total minimum costs previously calculated for three chord candidates are added respectively to connection costs respectively between the current chord candidates and three chord candidates at the next preceding beat timing IPrevChordInx, whereby three sums are obtained. And the minimum sum among the three sums is determined as the optimum chord total minimum costs doOptimizeChordTotalMinimalCost[IChordIdx]. The chord candidate showing the minimum cost value at the next preceding beat timing IPrevChordIdx is defined as a next preceding optimum chord root OptimizizeChordRoutePrev[IChordInx] [iCurChord] leading to, the current chord candidate (array variable) to be stored in the RAM 103. In the minimum cost calculating process at step S506 in FIG. 5, the CPU 101 successively executes the minimum cost calculating process at each beat timing as the beat progresses from the leading beat of the musical piece.

Figure 17:
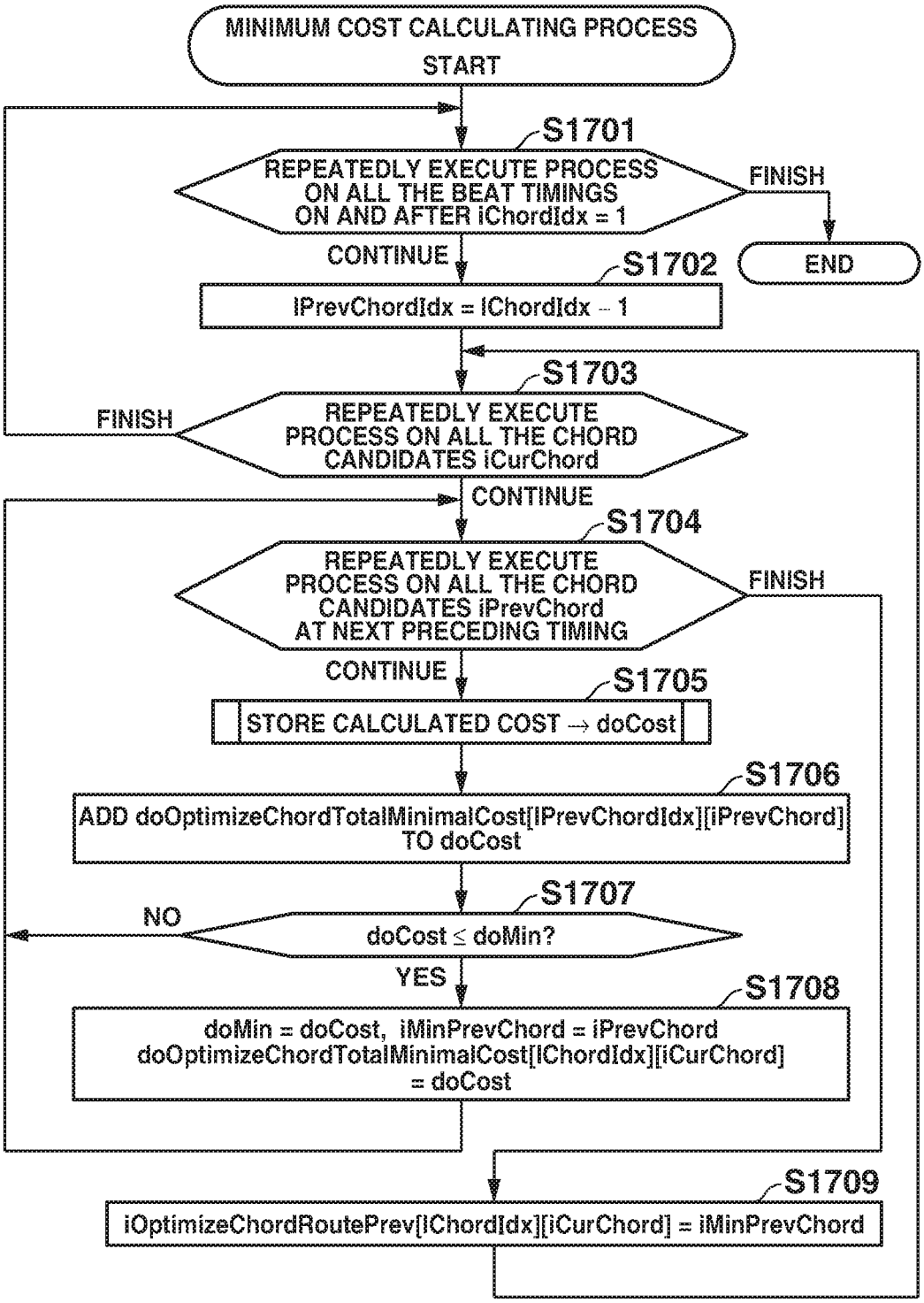
FIG. 17 is a flow chart of an example of the minimum cost calculating process of FIG. 16A.

FIG. 17 is a flow chart of an example of the minimum cost calculating process at step S506 in FIG. 5. The CPU 101 successively designates a current beat timing IChordIdx with respect to all the beat timings after IChordIdx=1 to repeatedly execute a series of processes at step S1702 to step S1708 (step S1701). In the case of IChordIdx=0, no calculation is executed since there exists no beat timing.

THE CPU 101 stores a value of (the current beat timing IChordIdx−1) to the next preceding beat timing IPrevChordIdx (step S1702).

The CPU 101 designates the candidate number iCurChord at the current beat timing with respect to all the chord candidates every current beat timing IchordIdx designated at step S1701 to repeatedly execute a series of processes at step S1704 to step S1709 (step S1703).

The CPU 101 designates the candidate number IPrevChord at the next preceding beat timing with respect to all the chord candidates at the next beat timing every candidate number iCurChord at the current beat timing designated at step S1703 to repeatedly execute a series of processes at step S1705 to step S1708 (step S1704).

In the processes at step S1705 to step S1709, the CPU 101 calculates the connection cost defined when the chord candidate of the candidate number IPrevChord at the next preceding beat timing designated at step S1704 is modulated to the chord candidate of the candidate number iCurChord at the current beat designated at step S1703, and stores the calculated cost as a cost doCost (as a variable) in the RAM 103 (step S1705).

The CPU 101 adds the optimum chord total minimum cost doOptimizeChordTotalMinimalCost[IPrevChordIdx] [iPrevChord] which has been held for the chord candidate of the candidate number iPrevChord at the next preceding beat timing designated at step S1703, to the cost doCost (step S1706). In the case of the next preceding beat timing IPrevChordIdx=0 at the current beat timing IChordIdx=1, the optimum chord total minimum cost doOptimizeChordTotalMinimalCost[0][iPrevChord] (iPrevChord=0, 1, 2) is 0.

The CPU 101 judges whether the cost doCost updated at step S1706 is not larger than the cost minimum value doMin which has been calculated up to the candidate number iCurChord at the current beat timing designated at step S1703 and stored in the RAM 103 (step S1707). The cost doCost is set to an initial large value when the CPU 101 designates a new candidate number iCurChord at the current beat timing at step S1703.

When it is determined NO at step S1707, the CPU 101 returns to the process at step S1704 and increments the candidate number iPrevChord to execute the process on the following candidate number iPrevChord at the next preceding beat timing.

When it is determined YES at step S1707, the CPU 101 stores the cost doCost to the cost minimum value doMin in the RAM 103 and stores the candidate number iPrevChord at the next preceding beat timing designated at step S1704 to a cost minimum next-preceding chord iMinPrevChord in the RAM 103. Further, the CPU 101 stores the current beat timing IChordIdx and the cost doCost onto the optimum chord total minimum costdoOptimizeChordTotalMinimalCost [IChordIdx][iCurChord] of the chord candidate of the candidate number iCurChord at the current beat timing (step S1708). Thereafter, the CPU 101 returns to the process at step S1704 and increments the candidate number iPrevChord to execute the process on the following candidate number iPrevChord at the next preceding beat timing.

Having executed a series of processes (step S1705 to step S1708) on each candidate number iPrevChord at the next preceding beat timing successively designated at step S1704, the CPU 101 finishes executing the process on all the candidate numbers iPrevChord (=0, 1, 2) at the next preceding beat timing, and then the CPU 101 executes the following process. The CPU 101 stores the current beat timing IChordIdx and the cost minimum next-preceding chord iMinPrevChor onto the next-preceding optimal chord root iOptimizeChordRoute Prev[IChordIdx][iCurChord] of the candidate number iCurChord at the current beat timing. Thereafter, the CPU 101 returns to the process at step S1703 and increments the candidate number iCurChord to execute the process on the following candidate number iCurChord at the current beat timing.

Executing the processes (step S1704 to step S1709) on the candidate number iCurChord successively designated at step S1703 at the current beat timing, the CPU 101 finishes executing the process on all the candidate numbers iPrevChord (=0, 1, 2) at the current beat timing, and returns to the process step S1701. The CPU 101 increments the beat timing IChordIdx to execute the process on the following candidate number at the following beat timing IchordIdx.

When the processes (step S1702 to step S1709) have been executed at each of the current beat timings IchordIdx sequentially designated at step S1703 and the process has finished at all the current beat timings IchordIdx, the CPU 101 finishes executing the minimum cost calculating process (flow chart in FIG. 17) at step S506 in FIG. 5.

Figure 18:
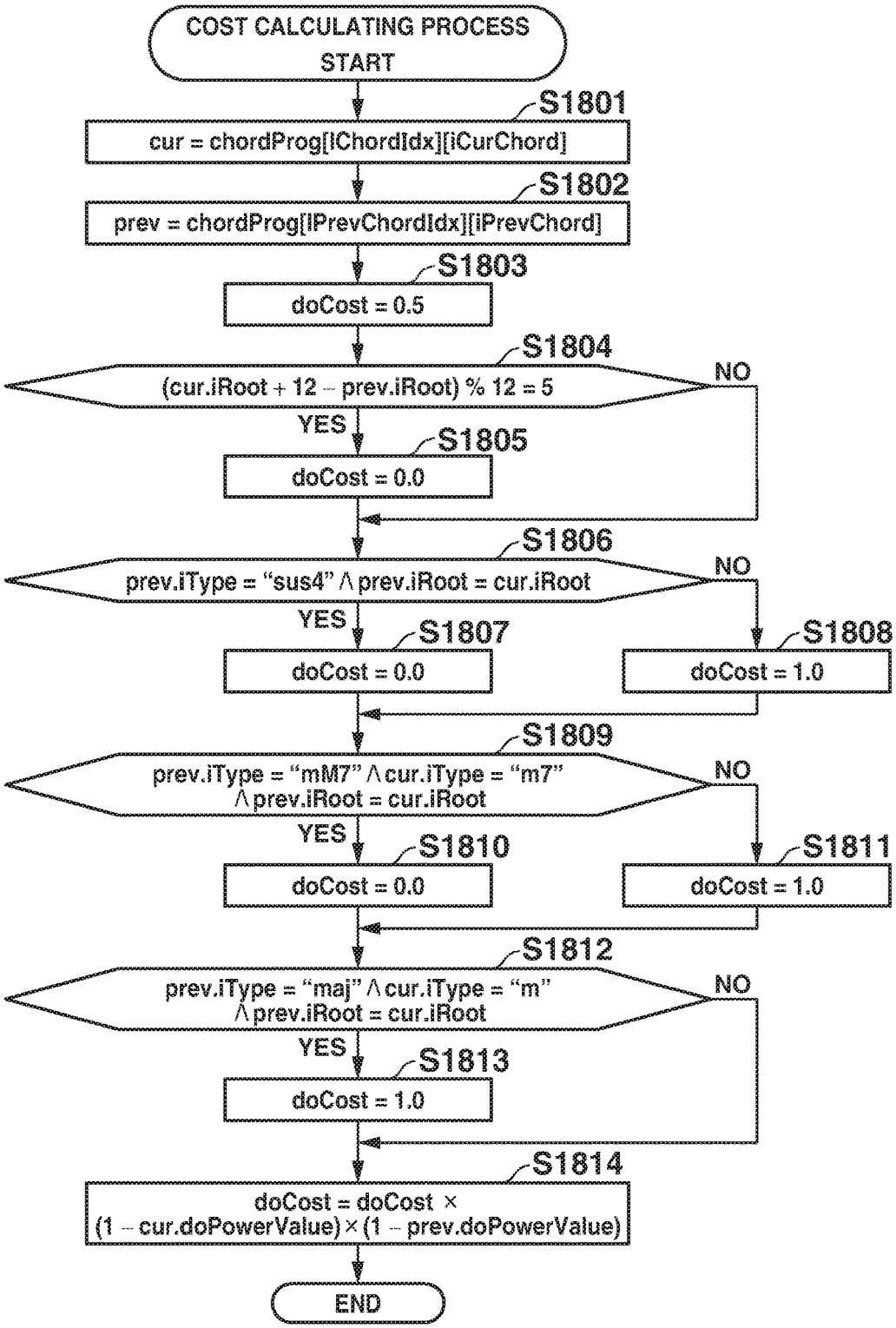
FIG. 18 is a flow chart of an example of a cost calculating process.

FIG. 18 is a flow chart of an example of the cost calculating process at step S1705 in FIG. 17. The CPU 101 stores the current beat timing IChordIdx and the pointer information chordProg[IChorgIdx][iCurChord] to the chord information (stored in the RAM 103, FIG. 3) of the candidate number iCurChord at the current timing onto the current pointer (a variable) "cur" stored in the RAM 103 (step S1801).

Similarly, the CPU 101 stores the next preceding beat timing IPrevChordIdx and the pointer information chordProg[IPrevChorgIdx] [iPrevChord] to the chord information (in the RAM 103) of the candidate number iPrevChord at the next preceding beat timing IPrevChordIdx onto the next preceding pointer (a variable) "prev" stored in the RAM 103 (step S1802).

The CPU 101 sets the connection cost doCost to an initial value 0.5 (step S1803).

The CPU 101 adds 12 to the chord root cur.IRoot (Refer to FIG. 3) in the chord information of the candidate number iCurChord at the current beat timing IChordIdx, further subtracting therefrom the chord root prev.IRoot (Refer to FIG. 3) in the chord information of the candidate number iPrevChord at the next preceding beat timing IPrevChordIdx, and divides the obtained value by 12, finding a reminder. Then, the CPU 101 judges whether the reminder is 5 or not (step S1804).

When it is determined YES at step S1804, then it is evaluated that the modulation from the chord candidate of the candidate number iPrevChord at the next preceding beat timing IPrevChordIdx to the chord candidate of the candidate number iCurChord at the current beat timing IChordIdx introduces natural change in chords with an interval difference of 5 degrees. In this case, the CPU 101 sets the best value or the lowest value 0.0 to the connection cost doCost (step S1805).

When it is determined NO at step S1804, the CPU 101 skips over the process at step S1805 to maintain the connection cost doCost at 0.5.

The CPU 101 judges whether the chord type prev.Type (Refer to FIG. 3) in the chord information of the candidate number iPrevChord in the next preceding beat timing iPrevChordIdx is "sus4" and the chord root prev.iRoot in the chord information is the same as the chord root cur.iRoot in the chord information of the candidate number iCurChord in the current beat timing iChordIdx (step S1806).

When it is determined YES at step S1806, then it is decided that this case (chord modulation) meets well the music rule: a chord following the chord of "sus4" often has the same chord root as the chord of "sus4", and introduces a natural chord modulation. In this case, the CPU 101 sets the best value or the lowest value 0.0 to the connection cost doCost (step S1807).

When it is determined NO at step S1806, the chord modulation is not natural. In this case, the CPU 101 sets the worst value 1.0 to the connection cost doCost (step S1808).

Then, the CPU 101 judges whether the chord type prev.iType in the chord information of the candidate number iPrevChord in the next preceding beat timing IPrevChordIdx is "mM7", and the chord type cur.iType in the chord information of the candidate number iCurChord in the current beat timing IChordIdx is "m7", and the chord root prev.iRpoot and the chord root cur.iRpoot in both chord information are the same (step S1809).

When it is determined YES at step S1809, the chord modulation meets well the music rule and very natural. In this case, the CPU 101 sets the best value or the lowest value 0.0 to the connection cost doCost (step S1810).

When it is determined NO at step S1809, the chord modulation is not natural. In this case, the CPU 101 sets the worst value 1.0 to the connection cost doCost (step S1811).

Further, the CPU 101 judges whether the chord type prev.iType in the chord information of the candidate number iPrevChord in the next preceding beat timing IPrevChordIdx is "maj", and the chord type cur.iType in the chord information of the candidate number iCurChord in the current beat timing IChordIdx is "m", and the chord root prev.iRpoot and the chord root cur.iRpoot in both chord information are the same (step S1812).

When it is determined YES at step S1812, the chord modulation is not natural. In this case, the CPU 101 sets the worst value 1.0 to the connection cost doCost (step S1813).

When it is determined NO at step S1812, the CPU 101 skips over the process at step S1813.

Finally, the CPU 101 subtracts the power evaluation value cur.doPowerValue in the chord information of the candidate number iCurChord in the current beat timing IChordIdx from 1 to obtain a first difference, and further subtracts the power evaluation value prev. doPowerValue in the chord information of the candidate number iPrevChord in the next preceding beat timing IPrevChordIdx from 1 to obtain a second difference. Then, the CPU 101 multiplies the first difference, the second difference and doCost, thereby adjusting the connection cost doCost (step S1814). Then the CPU 101 finishes the cost calculating process (flow chart in FIG. 18) at step S1705 in FIG. 17.

FIG. 16B is a view showing an example of the result of the minimum cost calculation performed in the minimum cost calculating process in FIG. 17, where the number of chord candidates is 2 (first and second candidate) and the beat timing iChordIdx is set to 0, 1, 2 and 3 for simplicity. In FIG. 16B, the bold line circles indicate the judged chord candidates. Values indicated in the vicinity of the lines connecting the bold line circles express connection costs doCost defined when one chord candidate is modulated to the other chord candidate, the connecting line starting from the one chord candidate and reaching the other chord candidate. It is judged in FIG. 16B that at the beat timing is 0, C maj is the first candidate and Cm is the second candidate, at the beat timing is 1, Am is the first candidate and AmM7 is the second candidate, at the beat timing is 2, Dm is the first candidate and D sus4 is the second candidate, and at the beat timing is 3, G7 is the first candidate and B dim is the second candidate.

In the minimum cost calculating process in FIG. 17, in the case of the current beat timing IChordIdx=1 and the candidate number iCurChord=0 (first chord), the current chord candidate is "Am". In this case, at the next preceding beat timing IPrevChordIdx=0, the connection cost doCost defined when the next preceding chord candidate "C maj" of the candidate number iPrevChord=0 (first candidate) is modulated to the current chord candidate "Am" is calculated using the algorism shown by the flow chart of FIG. 18 and 0.5 is obtained. The connection cost doCost defined when the next preceding chord candidate "Cm" of the candidate number iPrevChord=1 (second candidate) is modulated to the current chord candidate "Am" is calculated using the algorism shown by the flow chart of FIG. 18 and 0.5 is obtained. Both the optimal chord total minimum costs doOptimizeChordTotalMinimalCost[0][0/1] of the next preceding chord candidates "Cmaj" and "Cm" are 0. At step S1707 in FIG. 17, when the connection costs doCost is equivalent to the cost minimum value doMin, the latter chord candidate is given priority. Therefore, the optimal chord total minimum cost doOptimizeChordTotalMinimalCost [1][0] of the current chord candidate "Am" is calculated and 0.5 is obtained indicated in the bold line circle of "Am". As the next preceding optimum chord route iOptimizeChord RoutePrev[1][0] of the current chord candidate "Am", the next preceding chord candidate "Cm" is set, as indicated by the bold line arrow indicating the bold line circle of "Am".

In the case of the chord candidate of "A mM7" of the candidate number iCurChord=1 (second candidate) at the current beat timing IChordIdx=1, a calculation is performed in a similar manner. The optimal chord total minimum cost doOptimizeChordTotalMinimalCost[1][1] of the current chord candidate "A mM7" is calculated and 0.5 is obtained as indicated in the bold line circle of "A mM7". As the next preceding optimum chord route iOptimizeChord RoutePrev [1][1] of the current chord candidate "A mM7", the next preceding chord candidate "Cm" is set, as indicated by the bold line arrow indicating the bold line circle of "A mM7".

When the current beat timing progresses by 1 to IChordIdx=2, the current chord candidate will be "Dm" at the candidate number iCurChord=0 (first chord). In this case, at the next preceding beat timing IPrevChordIdx=1, the connection cost doCost defined when the next preceding chord candidate "Am" of the candidate number iPrevChord=0 (first candidate) is modulated to the current chord candidate "Dm" is calculated using the algorism shown by the flow chart of FIG. 18 and a value of 0.0 is obtained. The connection cost doCost defined when the next preceding chord candidate "A mM7" of the candidate number iPrevChord=1 (second candidate) is modulated to the current chord candidate "Dm" is calculated using the algorism shown by the flow chart of FIG. 18 and a value of 1.0 is obtained. Both the optimal chord total minimum costs doOptimizeChordTotalMinimalCost [0][0/1] of the next preceding chord candidates "Am" and "A mM7" are 0.5. Therefore, the connection cost doCost defined when the next preceding chord candidate "Am" is modulated to the current chord candidate "Dm" at step S1706 in FIG. 17 will be (0.5+0.0=0.5). Similarly, the connection costs doCost defined when the next preceding chord camdidate "A mM7" is modulated to the current chord candidate "Dm" at step S1706 will be (0.5+1.0=1.5). Therefore, the optimal chord total minimum costs doOptimizeChordTotalMinimalCost[2][0] of the current chord candidate "Dm" will be 0.5 as indicated in the bold line circle of "Dm". As the next preceding optimum chord route iOptimizeChord RoutePrev [2][0] of the current chord candidate "Dm", the next preceding chord candidate "Am" is set, as indicated by the bold arrow indicating the bold line circle of "Dm".

With respect to the chord candidate of "Dsus4" of the candidate number iCurChord=1 (second candidate) at the current beat timing IChordIdx=2, the calculation is performed in a similar manner. The optimal chord total minimum cost doOptimizeChordTotalMinimalCost[2][1] of the current chord candidate "Dsus4" is calculated and 0.5 is obtained as indicated in the bold line circle of "Dsus4". As the next preceding optimum chord route iOptimizeChord RoutePrev[2][1] of the current chord candidate "Dsus4", the next preceding chord candidate "Am" is set, as indicated by the bold arrow indicating the bold line circle of "Dsus4".

When the current beat timing further progresses by 1 to IChordIdx=3, the current chord candidate will be "G7" with the candidate number iCurChord=0 (first chord). In this case, at the next preceding beat timing IPrevChordIdx=2, the connection cost doCost defined when the next preceding chord candidate "Dm" of the candidate number iPrevChord=0 (first candidate) is modulated to the current chord candidate "G7" is calculated using the algorism shown by the flow chart of FIG. 18 and 0.0 is obtained. The connection cost doCost defined when the next preceding chord candidate "Dsus4" of the candidate number iPrevChord=1 (second candidate) is modulated to the current chord candidate "G7" is calculated using the algorism shown by the flow chart of FIG. 18 and 1.0 is obtained. Both the optimal chord total minimum costs doOptimizeChordTotalMinimalCost[0][0/1] of the next preceding chord candidates "Dm" and "Dsus4" are 0.5. Therefore the connection costs doCost defined when the next preceding chord candidate "Dm" is modulated to the current chord candidate "G7" will be (0.5+0.0=0.5). Similarly, the connection costs doCost defined when the next preceding chord candidate "Dsus4" is modulated to the current chord candidate "G7" will be (0.5+1.0=1.5). Therefore, the optimal chord total minimum cost doOptimizeChordTotalMinimalCost[3][0] of the current chord candidate "G7" will be 0.5 as indicated in the bold line circle of "G7". As the next preceding optimum chord route iOptimizeChordRoutePrev[3][0] of the current chord candidate "G7", the next preceding chord candidate "Dm" is set, as indicated by the bold arrow indicating the bold line circle of "G7".

In the case of the chord candidate of "Bdim" of the candidate number iCurChord=1 (second candidate) at the current beat timing IChordIdx=3, the calculation is performed in a similar manner. The optimal chord total minimum cost doOptimizeChordTotalMinimalCost[3][1] of the current chord candidate "Bdim" is calculated and 1.0 is obtained as indicated in the bold line circle of "Bdim". As the next preceding optimum chord route iOptimizeChord RoutePrev[2][1] of the current chord candidate "Bdim", the next preceding chord candidate "Dm" is set, as indicated by the bold arrow indicating the bold line circle of "Bdim".

The route confirming process at step S507 in FIG. 5 will be described in detail. In the route confirming process, the CPU 101 calculates the optimal chord total minimum cost doOptimizeChordTotalMinimalCost[IChordIdx] [iCurChord1] of the chord candidate of every candidate number iCurChord at every beat timing IChordIdx sequentially selected in the opposite direction from the tail beat timing to the leading beat timing and searches for the minimum calculated cost, selecting a chord candidate at each beat timing, while tracing the next preceding optimal chord route iOptmizeChordRoutePrev[IChordIdx][iCurChord], and sets the selected chord candidate to the first candidate.

In the example shown in FIG. 16B, at the tail beat timing IChordIdx=3, the chord candidate "G7" of the candidate number iCurChord=0, whose optimal chord total minimum cost is the minimum value of 0.5, is selected as the first candidate at the beat timing IChordIdx=3. The next preceding optimal chord route iOptmizeChordRoutePrev[3][0], the chord candidate "G7", set as the first candidate at the beat timing IChordIdx=3, is referred to, and the chord candidate "Dm" of the candidate number iCurChord=0 is selected and set as the first candidate at the beat timing before IChordIdx=2. Further, the next preceding optimal chord route iOptmizeChordRoutePrev[2][0], the chord candidate "Dm", set as the first candidate at the beat timing IChordIdx=2 is referred to, and the chord candidate "Am" of the candidate number iCurChord=0 is selected at the beat timing before IChordIdx=1 and set as the first candidate at the beat timing IChordIdx=1. Finally, the next preceding optimal chord route iOptmizeChordRoutePrev[1][0], the chord candidate "Am", set as the first candidate at the beat timing IChordIdx=1 is referred to, and the chord candidate "Cm" of the candidate number iCurChord=1 is selected at the next preceding leading beat timing IChordIdx=0, and set as the first candidate at the beat timing IChordIdx=0. As a result of the performed route confirming process, the chord candidates of the first candidates, "Cm", "Am", "Dm", and "G7" are successively selected respectively at the beat timings as the optimum chord progress and displayed on the displaying unit 105.

Figure 19:
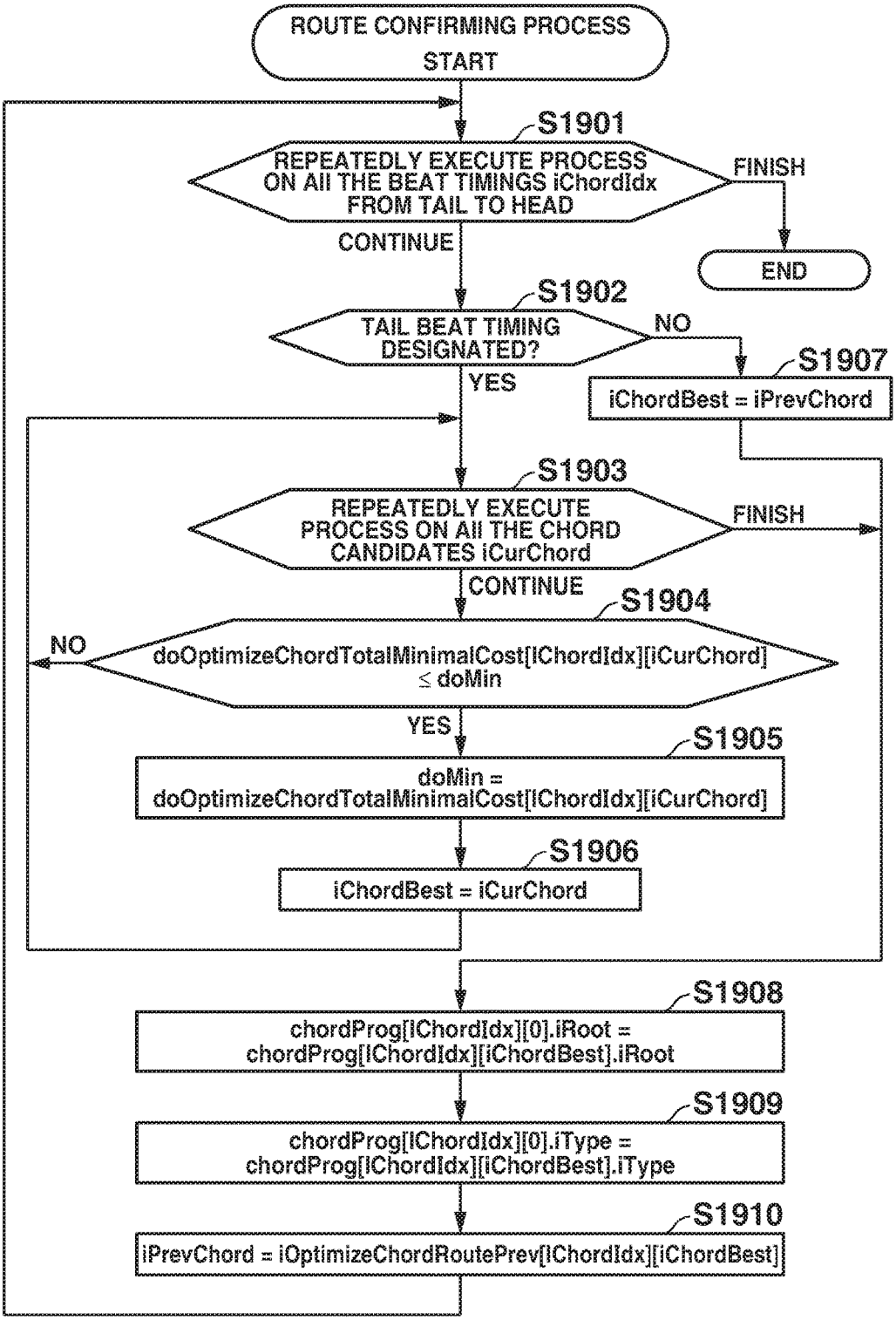
FIG. 19 is a flow chart showing an example of route confirming process in detail.

FIG. 19 is a flow chart of an example of the route confirming process at step S507 in FIG. 5. In the route confirming process the CPU 101 sequentially decrements the beat timing IChordIdx in the opposite direction from the tail beat timing to the leading beat timing and repeatedly executes a series of processes (step S1902 to step S1906) respectively at all the beat timings (step S1901).

In the processes at step 1902 to step S1906, the CPU 101 judges whether the tail beat timing has been designated (step S1902).

The CPU 101 repeatedly executes a series of processes (step S1904 to step S1906) on all the chord candidates of the candidate number iCurChord at the tail beat timing IChordIdx designated at step S1901 (step S1903). In the processes, candidate number iCurChord is searched for, which shows the minimum value of the optimal chord total minimum cost doOptimizeChordTotalMinimalCost[IChordIdx][iCurChord1] at the tail beat timing IChordIdx, as described in FIG. 16B.

In the processes executed repeatedly at step 1904 to step S1906, the CPU 101 judges whether the optimal chord total minimum cost doOptimizeChordTotalMinimalCost [IChordIdx][iCurChord1] of the candidate number iCurChord designated at step S1903 at the tail beat timing IChordIdx designated at step S1901 is not larger than the cost minimum value doMin stored in the RAM 103 (step S1904). The cost minimum value doMin is initially set to a large value.

When it is determined NO at step S1904, the CPU 101 returns to the process at step S1903 and increments the candidate number iCurChord.

When it is determined YES at step S1904, the CPU 101 sets the optimal chord total minimum cost doOptimizeChordTotalMinimalCost[IChordIdx][iCurChord1] of the candidate number iCurChord designated at step S1903 and at the tail beat timing IChordIdx designated at step S1901 to the cost minimum value doMin stored in the RAM 103 (step S1905).

The CPU 101 sets the candidate number iCurChord currently designated at step S1903 to the best chord candidate number iChordBest in RAM 103 (step S1906). Then the CPU 101 returns to the process at step S1903 and increments the candidate number iCurChord to execute the process thereon.

When the processes at step 1904 to step S1906 have been executed on all the candidate numbers iCurChord, the CPU 101 moves to the process at step S1908. In this state, as the best chord candidate number iChordBest, the chord candidate number of the chord candidate showing the minimum value of the optimal chord total minimum cost will be obtained at the tail beat timing. At step S1908, the CPU 101 stores the chord root chordProg[IChordIdx][iChordBest].iRoot in the chord information of the best chord candidate number iChordBest at the tail beat timing IChordIdx onto the chord root chordProg[IChordIdx][0].iRoot in the chord information of the first candidate at the tail beat timing IChordIdx (step S1908).

Then, the CPU 101 stores the chord type chordProg [[IChordIdx][iChordBest].iType in the chord information of the best chord candidate number iChordBest in the current tail beat timing IChordIdx onto the chord type chordProg [IChordIdx][0].iType in the chord information of the first candidate in the current tail beat timing IChordIdx (step S1909).

The CPU 101 stores the next preceding optimal chord route iOptmizeChordRoutePrev[IChordIdx][iChordBest] of the chord candidate of the best chord candidate number iChordBest in the current tail beat timing IChordIdx onto the candidate number iPrevChord in the next preceding beat timing (step S1910). Then the CPU 101 returns to the process at step S1901 and decrements the beat timing iChordIdx to execute the process thereon.

When the timing comes to the beat timing just before the tail, it is determined NO at step S1902. The CPU 101 stores the next preceding optimal chord route which was stored in the candidate number iPrevChord of the next preceding beat timing at step S1910, onto the best chord candidate number iChordBest (step S1907).

Further, executing the processes at step S1908 and step S1909, the CPU 101 stores the chord route chordProg [IChordIdx][iChordBest].iRoot and the chord type chordProg[IChordIdx][iChordBest].iType in the chord information of the best chord candidate number iChordBest in the current beat timing IChordIdx onto the chord route chordProg[IChordIdx][0].iRoot and the chord type chordProg [IChordIdx][0].iType in the chord information of the first candidate in the current beat timing IChordIdx, respectively.

Thereafter, the CPU 101 stores the next preceding optimal chord route iOptmizeChordRoutePrev[IChordIdx] [iChordBest] of the chord candidate of the best chord candidate number iChordBest in the tail beat timing IChordIdx onto the candidate number iPrevChord in the next preceding beat timing (step S1910). And the CPU 101 returns to the process at step S1901 and decrements the beat timing iChordIdx to execute the process thereon.

Having repeatedly executed the processes on each beat timing IChordIdx, the CPU 101 can output the optimum progressions of chords as the chord route chordProg[IChordIdx][0].iRoot and the chord type chordProg[IChordIdx][0].iType in the chord information of the first candidate in each beat timing IChordIdx, respectively.

In the minimum cost calculating process at step S506 in FIG. 5, since the musical connection rule is used, a more natural chord judgment can be made, even if plural chord candidates are found.

In the embodiments described above, the tonality judgment in which a modulation are judged appropriately allows an accurate judgment of chords.

In the above embodiments, the chord judgment has been described using MIDI sequence data as data of a musical piece, but the chord judgment can be made based on a audio signal in place of the MIDI sequence data. In this case, Fourier transform is used to analyze an audio signal, thereby calculating a pitch class power.

In the embodiments described above, the control unit for performing various controlling operations is composed of a CPU (a general processor) which runs a program stored in ROM (a memory). But it is possible to compose the control unit from plural processors each specialized in a special operation. It is possible for the processor to have a general processor and/or a specialized processor with its own specialized electronic circuit and a memory for storing a specialized program.

For instance, when the control unit is composed of the CPU executing the program stored in ROM, examples of the programs and processes executed by the CPU will be given below:

(Configuration 1)

The processor uses music data stored in a memory; estimates a first tonality based on component tones included in a first segment having a first length, the first segment being specified in the data of the musical piece; estimates a second tonality based on component tones included in a second segment having a second length different from the first length, the second segment being specified in the data of the musical piece and at least partially overlapping with the first segment; and compares the estimated first tonality with the estimated second tonality to judge a tonality or a chord of the first segment of the musical piece.

(Configuration 2)

In the above configuration, the processor compares the estimated first tonality with the estimated second tonality to decide an appropriate tonality; and judges a chord of the first segment of the musical piece based on the decided appropriate tonality.

(Configuration 3)

In the above configuration, the processor judges component tones of each beat in a measure of the musical piece; and determines a chord of the beat based on the component tones judged at the beat.

(Configuration 4)

In the above configuration, the processor decides a value of power information of each of musical tones of the musical piece which is made note-on within a time period of the first segment, the second segment or the beat, based on the musical tone's velocity and sounding time length in the time period in judging chord tones respectively in the first segment, the second segment or the beat; and accumulates the decided values of power information for pitch classes corresponding respectively to pitches of the musical tones to calculate accumulative values of power information respectively for the pitch classes in the first segment, the second segment or the beat.

(Configuration 5)

In the above configuration, when the pitch classes corresponding to the pitches of the musical tones coincide respectively with scale tones in the candidates for the first tonality, scale tones in the candidate for the second tonality or component tones in the candidate for a chord, correspondingly to candidates for the first tonality of the first segment, the second tonality of the second segment or a chord of a beat, the processor accumulates the calculated accumulative values of power information for the pitch classes to find first power evaluation values; and when the pitch classes corresponding to the pitches of the musical tones do not coincide with the scale tones in the candidates for the first tonality, the scale tones in the candidate for the second tonality or the scale tones in the candidate for a chord, the processor accumulates the accumulative values of power information calculated in the pitch classes to find second power evaluation values; and the processor compares the first power evaluation values and the second power evaluation values found respectively for the candidates for the first tonality and the second tonality or the chord to judge the first tonality, the second tonality or the chord respectively in the first segment, the second segment, or the beat.

(Configuration 6)

In the above configuration, the first segment has a first segment length equivalent to one measure and the second segment has a second segment length equivalent to multiples of one measure; and the processor compares the first tonality and the second tonality judged for each measure in which the first segment and the second segment overlap each other to determine an appropriate tonality of the measure.

(Configuration 7)

In the above configuration, the processor sequentially specifies the first segments having the first segment length or the second segments having the second segment length in the data of the musical piece, each with a starting position shifted by one measure.

(Configuration 8)

In the above configuration, the processor displays the judged chords on a displaying unit.

(Configuration 9)

A chord judging apparatus for judging chords of a musical piece, provided with a processor and a memory for storing data of the musical piece, wherein the processor specifies plural segments in the data of the musical piece; estimates a tonality of each of the specified segments based on component tones included in the segment; and judges a chord of the plural segments of the musical piece based on modulation in tonality, when modulation is introduced in the estimated tonalities of the plural segments.

(Configuration 10)

In the above chord judging apparatus, the processor estimates a first tonality of a first segment having a first length based on component tones included in the first segment, the first segment being specified in the data of the musical piece; estimates a second tonality of a second segment having a second length based on component tones included in the second segment, the second segment being specified in the data of the musical piece and partially overlapping with the first segment; compares the estimated first tonality with the estimated second tonality to judge a tonality of the first segment of the musical piece; and judges a chord of the first segment of the musical piece based on the judged tonality of the first segment.

When the control unit is composed of plural specialized processors, it is possible to arbitrarily decide how many specialized processors are used or to which controlling operation a specialized processor is assigned. A configuration is described below, in which plural specialized processors are assigned to various sorts of controlling operations respectively.

(Configuration 11)

The control unit is composed of a tonality estimating processor (tonality estimating unit) which estimates a first tonality based on component tones included in a first segment having a first length, the first segment being specified in music data stored in the memory, and estimates a second tonality based on component tones included in the second segment having a second length different from the first length, the second segment being specified in the music data and at least partially overlapping with the first segment; a tonality deciding processor (tonality deciding unit) which compares the estimated first tonality with the estimated second tonality to decide an appropriate tonality; and a chord judging processor (chord judging unit) which judges a chord of the first segment of the musical piece based on the appropriate tonality.

What is claimed is:

1. A chord judging method performed by a processor to judge chords of a musical piece whose data is stored in a memory, the method comprising executing, with the processor, processes of:

estimating a first tonality based on component tones included in a first segment having a first length, the first segment being specified in the data of the musical piece;

estimating a second tonality based on component tones included in a second segment having a second length different from the first length, the second segment being specified in the data of the musical piece and at least partially overlapping with the first segment;

comparing the estimated first tonality with the estimated second tonality to judge a tonality or a chord of the first segment of the musical piece;

comparing the estimated first tonality with the estimated second tonality to decide an appropriate tonality; and judging a chord of the first segment of the musical piece based on the decided appropriate tonality.

2. The chord judging method according to claim 1, wherein the first segment has a first segment length equivalent to one measure and the second segment has a second segment length equivalent to multiples of one measure; and the processor executes a process of:

comparing the first tonality and the second tonality judged for each measure in which the first segment and the second segment overlap each other to determine an appropriate tonality of the measure.

3. The chord judging method according to claim 2, wherein the processor executes a process of:

sequentially specifying the first segments having the first segment length or the second segments having the second segment length in the data of the musical piece, each with a starting position shifted by one measure.

4. The chord judging method according to claim 1, wherein the processor executes a process of:

displaying the judged chord on a displaying unit.

5. A chord judging method performed by a processor to judge chords of a musical piece whose data is stored in a memory, the method comprising executing, with the processor, processes of:

estimating a first tonality based on component tones included in a first segment having a first length, the first segment being specified in the data of the musical piece;

estimating a second tonality based on component tones included in a second segment having a second length different from the first length, the second segment being specified in the data of the musical piece and at least partially overlapping with the first segment;

comparing the estimated first tonality with the estimated second tonality to judge a tonality or a chord of the first segment of the musical piece;

judging component tones of each beat in a measure of the musical piece; and determining a chord of the beat based on the component tones judged at the beat.

6. The chord judging method according to claim 5, wherein the processor executes processes of:

deciding a value of power information of each of musical tones of the musical piece which is made note-on within a time period of the first segment, the second segment or the beat, based on the musical tone's velocity and sounding time length in the time period in judging component tones respectively in the first segment, the second segment or the beat; and accumulating the decided values of power information for pitch classes corresponding respectively to pitches of the musical tones to calculate accumulative values of power information respectively for the pitch classes in the first segment, the second segment or the beat.

7. The chord judging method according to claim 6, wherein when the pitch classes corresponding to the pitches of the musical tones coincide respectively with scale tones in the candidates for the first tonality, scale tones in the candidate for the second tonality or component tones in the candidate for a chord, correspondingly to candidates for the first tonality of the first segment, the second tonality of the second segment or a chord of a beat, the processor executes a process of (a) accumulating the calculated accumulative values of power information for the pitch classes to find first power evaluation values;

when the pitch classes corresponding to the pitches of the musical tones do not coincide with the scale tones in the candidates for the first tonality, the scale tones in the candidate for the second tonality or the scale tones in the candidate for a chord, the processor executes a process of:

(b) accumulating the accumulative values of power information calculated in the pitch classes to find second power evaluation values; and the processor executes a process of:

(c) comparing the first power evaluation values and the second power evaluation values found respectively for the candidates for the first tonality and the second tonality or the chord to judge the first tonality, the second tonality or the chord respectively in the first segment, the second segment, or the beat.

8. A non-transitory computer-readable recording medium with an executable program stored thereon, the executable program, when installed on a computer, making the computer execute processes of:

specifying plural segments in data of the musical piece stored in a memory;

estimating a tonality of each of the specified segments based on components tones included in the segment;

judging a chord of the plural segments of the musical piece based on modulation in tonality, when modulation is introduced in the estimated tonalities of the plural segments;

specifying a first segment having a first length in the data of the musical piece;

estimating a first tonality of the first segment based on component tones included in the first segment;

specifying a second segment having a second length different from the first length in the data of the musical piece, the second segment at least partially overlapping with the first segment;

estimating a second tonality based on component tones of the second segment;

comparing the estimated first tonality with the estimated second tonality to judge a tonality of the first segment of the musical piece; and judging a chord of the first segment of the musical piece based on the judged tonality of the first segment.

9. A chord judging apparatus for judging chords of a musical piece, the apparatus comprising:

a processor; and a memory for storing data of the musical piece;

wherein the processor executes processes of:

estimating a first tonality based on component tones included in a first segment having a first length, the first segment being specified in the data of the musical piece;

estimating a second tonality based on component tones included in a second segment having a second length different from the first length, the second segment being specified in the data of the musical piece and at least partially overlapping with the first segment;

comparing the estimated first tonality with the estimated second tonality to judge a tonality or a chord of the first segment of the musical piece;

comparing the estimated first tonality with the estimated second tonality to decide an appropriate tonality; and judging a chord of the first segment of the musical piece based on the decided appropriate tonality.

10. The chord judging apparatus according to claim 9, wherein the processor:

specifies plural segments in the data of the musical piece including the first segment and the second segment;

estimates a tonality of each of the specified segments based on component tones included in the segment; and judges a chord of the plural segments of the musical piece based on modulation in tonality, when modulation is introduced in the estimated tonalities of the plural segments.

11. The chord judging apparatus according to claim 9, wherein the processor:

judges component tones at each beat in a measure of the musical piece; and determines a chord of the beat based on the component tones judged at the beat;

decides a value of power information of each of musical tones of the musical piece which is made note-on within a time period of the first segment, the second segment or the beat, based on the musical tone's velocity and sounding time length in the time period in judging component tones respectively in the first segment, the second segment or the beat; and accumulates the decided values of power information for pitch classes corresponding respectively to pitches of the musical tones to calculate accumulative values of power information respectively for the pitch classes in the first segment, the second segment or the beat.

12. The chord judging apparatus according to claim 11, wherein when the pitch classes corresponding to the pitches of the musical tones coincide respectively with scale tones in the candidates for the first tonality, scale tones in the candidate for the second tonality or component tones in the candidate for a chord, correspondingly to candidates for the first tonality of the first segment, the second tonality of the second segment or a chord of a beat, the processor (a) accumulates the calculated accumulative values of power information for the pitch classes to find first power evaluation values; and when the pitch classes corresponding to the pitches of the musical tones do not coincide with the scale tones in the candidates for the first tonality, the scale tones in the candidate for the second tonality or the scale tones in the candidate for a chord, the processor (b) accumulates the accumulative values of power information calculated in the pitch classes to find second power evaluation values; and the processor (c) compares the first power evaluation values and the second power evaluation values found respectively for the candidates for the first tonality and the second tonality or the chord to judge the first tonality, the second tonality or the chord respectively in the first segment, the second segment, or the beat.

13. The chord judging apparatus according to claim 9, wherein the first segment has a first segment length equivalent to one measure and the second segment has a second segment length equivalent to multiples of one measure; and the processor compares the first tonality and the second tonality decided for each measure in which the first segment and the second segment overlap each other to determine an appropriate tonality of the measure.

14. The chord judging apparatus according to claim 13, wherein the processor sequentially specifies the first segments having the first segment length or the second segments having the second segment length in the data of the musical piece, each with a starting position shifted by one measure.

15. The chord judging apparatus according to claim 9, wherein the processor displays the judged chords on a displaying unit.

16. A chord judging apparatus for judging chords of a musical piece, the apparatus comprising:

a processor; and a memory for storing data of the musical piece;

wherein the processor executes processes of:

estimating a first tonality based on component tones included in a first segment having a first length, the first segment being specified in the data of the musical piece;

estimating a second tonality based on component tones included in a second segment having a second length different from the first length, the second segment being specified in the data of the musical piece and at least partially overlapping with the first segment;

comparing the estimated first tonality with the estimated second tonality to judge a tonality or a chord of the first segment of the musical piece;

judging component tones of each beat in a measure of the musical piece; and determining a chord of the beat based on the component tones judged at the beat.

* * * * *